US006921619B2

(12) United States Patent
Ohmura et al.

(10) Patent No.: US 6,921,619 B2
(45) **Date of Patent: *Jul. 26, 2005**

(54) ELECTROSTATIC IMAGE DEVELOPING

(75) Inventors: Ken Ohmura, Tokyo (JP); Asao Matsushima, Tokyo (JP); Hiroshi Yamazaki, Tokyo (JP); Yoshiki Nishimori, Tokyo (JP); Hiroyuki Yamada, Kanggawa (JP); Shiro Hirano, Tokyo (JP)

(73) Assignee: Konica Corporation, Tokyo (JP)

( * ) Notice: Subject to any disclaimer, the term of this patent is extended or adjusted under 35 U.S.C. 154(b) by 27 days.

This patent is subject to a terminal disclaimer.

(21) Appl. No.: 10/052,203

(22) Filed: Jan. 16, 2002

(65) Prior Publication Data

US 2002/0136976 A1 Sep. 26, 2002

(30) Foreign Application Priority Data

Jan. 18, 2001 (JP) ..... 2001-010347

(51) Int. Cl.[7] ..... G03G 9/08

(52) U.S. Cl. ..... 430/110.1; 430/108.4; 430/110.3; 430/111.4

(58) Field of Search ..... 430/110.1, 110.3, 430/108.1, 108.4, 111.4, 137.14

(56) References Cited

U.S. PATENT DOCUMENTS

| | | | | |
|---|---|---|---|---|
| 5,759,732 | A * | 6/1998 | Nakamura et al. | 430/108.1 |
| 5,965,316 | A * | 10/1999 | Kmiecik-Lawrynowicz et al. | 430/137.14 |
| 2001/0018158 | A1 * | 8/2001 | Yoshida et al. | 430/110.1 |
| 2001/0031412 | A1 * | 10/2001 | Itami et al. | 430/110.3 |
| 2002/0012863 | A1 * | 1/2002 | Akai et al. | 430/110.1 |
| 2002/0037469 | A1 * | 3/2002 | Kohyama et al. | 430/110.3 |
| 2003/0027072 | A1 * | 2/2003 | Horiuchi et al. | 430/110.1 |
| 2003/0049554 | A1 * | 3/2003 | Ohmura et al. | 430/110.2 |
| 2004/0043319 | A1 * | 3/2004 | Horiuchi et al. | 430/110.1 |

FOREIGN PATENT DOCUMENTS

| | | | | |
|---|---|---|---|---|
| JP | 06130723 | A * | 5/1994 | G03G/9/087 |
| JP | 06148936 | A * | 5/1994 | G03G/9/087 |
| JP | 11338192 | A * | 12/1999 | G03G/9/097 |
| JP | 2001255685 | A * | 9/2001 | G03G/5/147 |

* cited by examiner

*Primary Examiner*—Christopher RoDee
(74) *Attorney, Agent, or Firm*—Squire, Sanders & Dempsey L.L.P.

(57) ABSTRACT

An electrostatic image developing toner is disclosed. The toner has a domain-matrix structure; the average of the horizontal FERE diameter of the part corresponding to said domain is from 200 to 900 nm; and the variation coefficient of said horizontal FERE diameter is 40 percent or less.

18 Claims, 7 Drawing Sheets

TONER PARTICLE (a)

TONER PARTICLE (b)

TONER PARTICLE HAVING NO CORNERS

TONER PARTICLE HAVING CORNERS

TONER PARTICLE HAVING CORNERS

ELECTROSTATIC IMAGE DEVELOPING

The present invention relates to an electrostatic image developing toner and an image forming method which are employed in copiers and printers.

BACKGROUND OF THE INVENTION

In recent years, in image forming methods utilizing an electrophotographic system, image formation, utilizing the digital system, has been playing an increasing role due to progress in digital technology. In the image forming method utilizing said digital system, an image comprised of minute dots such as a pixel of 1,200 dpi (the number of dots per inch) is fundamentally visualized. As a result, high imaging technology is demanded so that images comprised of minute dots are faithfully reproduced.

From the viewpoint of achieving such high quality images, a decrease in the diameter of toner particles has been investigated. In the formation of electrophotographic images, heretofore, a so-called pulverized toner has been mainly employed. Said pulverized toner has been prepared in such a manner that binder resins and pigments are blended, kneaded, and subsequently pulverized, and the resultant toner powder is classified through a classifying process. The toner prepared employing such production processes is limited in decreasing the toner particle diameter as well as in narrowing the particle size distribution. It has been difficult to prepare toner particles having the desired particle size distribution as well as the desired uniform particle shape. As a result, it has been difficult to enhance the quality of electrophotographic images prepared by employing such pulverized toner to the demanded degree.

Recently, as a means to decrease the diameter of toner particles, to narrow the particle size distribution, and to acquire uniform particles, a polymerization toner, prepared by employing a suspension polymerization method or an emulsion polymerization method, has received attention. Said polymerization toner is prepared in such a manner that a raw material monomer is uniformly dispersed in a water based medium and subsequently undergoes polymerization. Therefore, technology to achieve coalescence (aggregation and fusion) of resinous particles prepared by said suspension polymerization or said emulsion polymerization with colorant particles is in the development stage.

On the other hand, as a system to fix toner images formed on an image forming support such as a paper sheet, a heating roll fixing system is widely employed in which said image forming support, on which a toner image has been formed, is passed between a heating roller and a pressing roller so as to achieve fixing. However, said heating roll fixing system has problems in which images tend to be stained due to off-setting in which the fused toner adheres to said heating roller.

As a means to minimize off-setting, it has been known that releasing properties can be provided on said heating roller by applying silicone oil onto the surface of said heating roller in a fixing unit. Said means is useful because the kinds of employed toner are not limited.

However, said means has not been suitable for preparing office documents because silicone oil is applied onto transfer sheets to make it impossible to write on said sheets with writing means such as ballpoint pens. Further, said means causes problems in that components, contained in said silicone oil, become volatile due to heat on the heating roller surface and adhere to and stain the optical system, as well as charging electrodes whereby image problems result.

From the viewpoint of the foregoing, oil-free fixing techniques have been increasingly demanded in which said silicone oil is not supplied to the fixing unit (or the heating roller) or the amount of said silicone oil supplied to said fixing unit is markedly decreased.

Further, machines have become more common which are fitted with units for high speed operation, which produce the number of copies with response to print-on-demand, and are fitted with finishers such as an inner binding bookbinding mechanism. In these units, during bookbinding, bound paper sheets come into contact with each other, and problems occur in which toner on a paper sheet is transferred onto the white background of the paper sheet of the following page and is rubbed to result in staining.

In order to overcome such drawbacks, providing releasing properties to the toner itself has been widely carried out by incorporating releasing agents such as wax into said toner. Releasing agent particles are incorporated into the toner (the polymerization toner) which is prepared employing the aforesaid polymerization methods, and a method is known in which during the polymerization process, resinous particles and releasing agent particles are allowed to coalesce. However, it is extremely difficult to incorporate a sufficient amount of releasing agent into the interior of said coalesced particles (colored particles) of the toner prepared by said methods. Further, the content of said releasing argents among resultant coalesced particles fluctuates. As a result, the toner as a whole is not capable of exhibiting sufficient releasing properties (off-setting resistance).

In order to overcome these drawbacks, as disclosed in Japanese Patent in Publication Open to Public Inspection No 8-41468, compounds employed for releasing agents are improved and techniques to increase the addition amount into toner are investigated. However, due to the structural cause in that toner is comprised of coalesced particles of resinous particles and releasing agent particles, releasing agents are released from coalesced particles, and the resultant releasing agents cause problems whereby said releasing agents degrade developers, decrease toner fluidity, and generate photoreceptor filming.

Further, Japanese Patent Publication Open to Public Inspection Nos. 3-296067, 10-161338, and 5-88409 disclose toners which are comprised of a domain-matrix structure such that a releasing agent phase in the toner particle structure is subjected to phase separation in the binding resin phase. However, these patent publications do not mention any fluctuation of the added amount of releasing agents in toner particles and do not disclose any suggestion to control said fluctuation. Further, even though toners disclosed in these are comprised of a structure in which releasing agents are subjected to phase separation, the resultant releasing agent phase exists in the center of the toner particle as an aggregate, whereby it is difficult to effectively bleed the releasing agents to the exterior of the toner particle. As a result, it is inevitable to increase the amount of releasing agents incorporated into toner particles. Further, it is difficult to bleed an optimal amount of the releasing agents to the exterior of the particle during image fixing, due to the fact that said releasing agents are required to migrate to the exterior of the particle. As a result, it has been extremely difficult to sufficiently minimize off-setting.

SUMMARY OF THE INVENTION

A first object of the present invention is to provide an electrostatic image developing toner which results in excellent off-setting resistance while matching oil-free fixing, results in suitable gloss, and is capable of achieving stable formation of high quality images without staining over an extended period of time.

A second object of the present invention is to provide an electrostatic image developing toner which results in no photoreceptor filming as well as excellent cleaning properties.

A third object of the present is to provide an electrostatic image developing toner which results in sufficient resistance against rubbing between paper sheets as well as the contact with other paper sheets, and results in a degree of fixability which does not stain paper sheets when printed paper sheets are stored while being stacked during bookbinding.

A fourth object of the present invention is to provide an electrostatic image developing toner which exhibits excellent developability as well as excellent fine line reproduction, and is capable of achieving stable formation of high quality images over an extended period of time.

A fifth object of the present invention is to provide an image forming method employing the excellent toner described above.

In order to solve the aforesaid problems, the inventors of the present invention paid close attention to the structure of the polymerization toner comprised of a domain-matrix structure, which was prepared by coalescing resinous particles of the present invention and crystalline materials, and discovered that the problems of the present invention were solved by specifying the shape of the crystalline material region in a toner particle. The toner of the present invention and its embodiments will now be described.

1. An electrostatic image developing toner, which comprises a resin, a colorant, and a crystalline material, wherein the particle of said toner is comprised of a domain-matrix structure; the average of the horizontal FERE diameter of the part corresponding to said domain is from 200 to 900 nm; and the variation coefficient of said horizontal FERE diameter is 40 percent or less.
2. An electrostatic image developing toner, which comprises a resin, a colorant, and a crystalline material, wherein the particle of said toner is comprised of a domain-matrix structure and the ratio of toner particles having from 1 to 20 domains per said toner particle is at least 99 percent by number of the toner as whole.
3. An electrostatic image developing toner, which comprises a resin, a colorant, and a crystalline material, wherein the particle of said toner is comprised of a domain-matrix structure; the average of the shape factor of said domain is from 140 to 220; its variation coefficient is 35 percent or less; the ratio of domains having said shape factor in the range of 100 to 120 is 10 percent or less; and the ratio of domains having said shape factor of at least 240 is 15 percent or less.
4. An electrostatic image developing toner, which comprises a resin, a colorant, and a crystalline material, wherein the particle of said toner is comprised of a domain-matrix structure; the average of the shape factor of said domain is from 160 to 200; its variation coefficient is 35 percent or less; the ratio of domains having said shape factor in the range of 100 to 120 is 5 percent or less; and the ratio of domains having said shape factor of at least 240 is 10 percent or less.
5. An electrostatic image developing toner, which comprises a resin, a colorant, and a crystalline material, wherein the particle of said toner is comprised of a domain-matrix structure; the average of the area of a Voronoi polygon formed by the perpendicular bisecting line between the centers of gravity of domains adjacent to each other in said domain-matrix structure is from 20,000 to 120,000 $nm^2$; and the variation coefficient of the area of said Voronoi polygon is 25 percent or less.
6. An electrostatic image developing toner, which comprises a resin, a colorant, and a crystalline material, wherein the particle of said toner is comprised of a domain-matrix structure; the average of the area of a Voronoi polygon formed by the perpendicular bisecting line between the centers of gravity of domains adjacent to each other in said domain-matrix structure is from 40,000 to 100,000 $nm^2$; and the variation coefficient of the area of said Voronoi polygon is 20 percent or less.
7. An electrostatic image developing toner, which comprises a resin, a colorant, and a crystalline material, wherein the particle of said toner is comprised of a domain-matrix structure; the average of the area of a Voronoi polygon formed by the perpendicular bisecting line between the centers of gravity of domains adjacent to each other in said domain-matrix structure is from 20,000 to 120,000 $nm^2$; and 20 to 30 percent by number of domains having an area of at least 160,000 $nm^2$ are incorporated.
8. An electrostatic image developing toner, which comprises a resin, a colorant, and a crystalline material, wherein the particle of said toner is comprised of a domain-matrix structure; the average of the area of a Voronoi polygon formed by the perpendicular bisecting line between the centers of gravity of the domains in the interior of a 1,000 nm radius circle having the center of gravity in the cross-section of said toner particle as the center is smaller than the average of the area of a Voronoi polygon formed by the perpendicular bisecting line between the centers of gravity of said domain in the exterior of said circle.
9. An electrostatic image developing toner, which comprises a resin, a colorant, and a crystalline material, wherein the particle of said toner is comprised of a domain-matrix structure, and of Voronoi polygons formed by the perpendicular bisecting line between the centers of gravity of domains adjacent to each other in said domain-matrix structure, there are 5 to 30 domains having an area of the voronoi polygon of at least 160,000 $nm^2$ which comes into contact with the external circumference of said toner.
10. The electrostatic image developing toner, described in any one of 1. through 9. above, which comprises a resin, a colorant, and a crystalline material, wherein the particle of said toner is comprised of a domain-matrix structure, and said domains are comprised of ones having different luminance.
11. The electrostatic image developing toner, described in any one of 1. through 10. above, which comprises a resin, a colorant, and a crystalline material, wherein the particle of said toner is comprised of a domain-matrix structure, and said resin forms the portion corresponding to non-domain portion around said domain, and in addition said domains are comprised of domains comprised of said crystalline material and domains comprised of said colorant.
12. The electrostatic image developing toner, described in any one of 1. through 11. above, wherein the ratio of toner particles without corners is at least 50 percent by number and the number variation coefficient in the number particle size distribution is 27 percent or less.
13. The electrostatic image developing toner, described in any one of 1. through 11. above, wherein the ratio of toner particles, having a shape factor in the range of 1.2 to 1.6, is at least 65 percent by number, and the number variation coefficient in the number particle size distribution is 27 percent or less.

14. The electrostatic image developing toner, described in any one of 1. through 11. above, wherein sum M of relative frequency m1 and m2 of toner particles is at least 70 percent, which is included in the most frequent class in the histogram which shows the particle size distribution based on the number of particles which is drawn in such a manner that regarding said toner, when the particle diameter of toner particles is represented by D in $\mu$m, natural logarithm in D is taken as the abscissa, and said abscissa is divided into a plurality of classes at an interval of 0.23.
15. The electrostatic image developing toner, described in any one of 1. through 11. above, wherein said toner has a number average particle diameter of 3 to 9 $\mu$m.
16. The electrostatic image developing toner, described in any one of 1. through 15. above, wherein said toner is prepared by polymerizing at least a polymerizable monomer in a water-based medium.
17. The electrostatic image developing toner, described in any one of 1. through 16. above, wherein said toner is prepared by aggregating and fusing at least resinous particles in a water-based medium.
18. The electrostatic image developing toner, described in any one of 1. through 17. above, wherein said toner is prepared by salting out/fusing colorant particles and fine composite resinous particles which have been formed through a process to polymerize a polymerizable monomer after dissolving a crystalline material in at least said polymerizable monomer.
19. The electrostatic image developing toner, described in any one of 1. through 18. above, wherein said toner is prepared by salting out/fusing colorant particles and fine composite resinous particles prepared by a multi-step polymerization method.
20. The electrostatic image developing toner, described in any one of 1. through 19. above, wherein said toner is prepared by forming a resinous layer which is prepared by fusing resinous particles employing a salting-out/fusion method on resinous and colored particles.
21. In an image forming method comprised of processes in which an electrostatic latent image, formed on a photoreceptor, is visualized, and said visualized image is transferred onto a sheet of recording paper and thermally fixed, an image forming method wherein said image is visualized employing said electrostatic image developing toner.
22. An image forming method wherein irradiation onto said photoreceptor is carried out employing digital exposure.

DETAILED DESCRIPTION OF THE INVENTION

Figure 1:
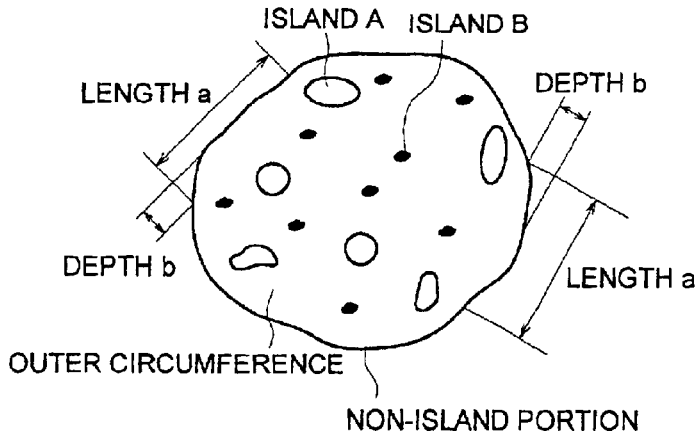
FIG. 1 is a schematic view explaining a toner particle comprised of a domain-matrix structure of the present invention or beyond the present invention.
Figure 1:
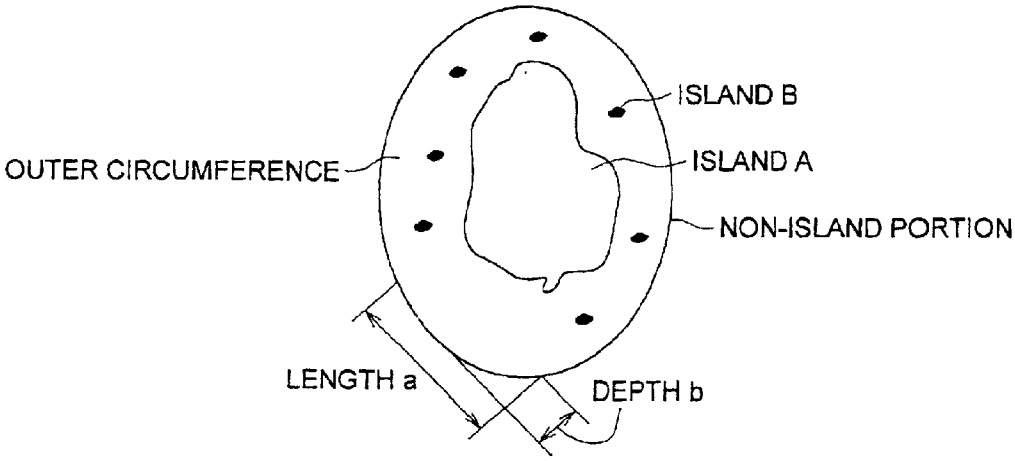

The toner particles of the present invention are comprised of a domain-matrix structure. The domain-matrix structure, as described herein, refers to the structure in which in a continuous phase, domain-shaped phases having closed interfaces (interfaces between phases) are located. Namely, in the toner of the present invention, each component of resins, colorants, and crystalline materials, which constitute toner particles, are mutually insoluble and forms phases independently, so that toner particles are formed so as to comprise said domain-matrix structure. As a result, the toner of the present invention is comprised of a structure in which in the continuous phase as the non-domain potion around said domain, domains comprised of crystalline materials as well as domains comprised of colorants are located.

The toner particles of the present invention are comprised of a structure in which in the continuous phase, the phase of the component is located in the form of domains. In the present invention, by adjusting the average of the horizontal FERE diameter of domains constituting said toner particles to the specified range, it is possible to markedly decrease the amount of crystalline materials which are released from toner particles, so that said crystalline materials which have been incorporated into toner particles effectively exhibit their function during image formation. As a result, off-setting as well as photoreceptor filming is minimized.

Namely, in conventional techniques, crystalline materials, incorporated into a polymerization toner, have tended to be released from toner particles, but the present invention overcomes said drawbacks. In the present invention, reasons to effectively minimize formation of released crystalline materials have not yet been fully clarified. However, it is assumed that since the shape of added crystalline material based on the conventional technique is spherical or nearly spherical, said added crystalline material particles easily migrate in the toner particle, or are not firmly held in the interior of the toner particle due to the small contact area in the toner particle, whereby they are easily dislodged from the toner particle.

Contrary to this, it is assumed that since, in the toner particles of the present invention, domains comprised of crystalline materials in the toner particle are firmly held in the particle, said crystalline materials are stably and firmly held without being released except for pressure fixing process, while during press fixing, a function is provided in which said crystalline materials are rapidly and assuredly bled to the exterior of said toner particle. Further, by forming a protective layer comprised of crystalline materials having a low friction coefficient, employing said crystalline materials having a releasing function which are optimally bled to the exterior of the toner particles, it is possible to overcome stain problems and in particular to minimize staining which is formed when image information printed paper sheets are bound and stacked during cases such as bookbinding.

The fact that the toner particles of the present invention are comprised of a domain-matrix structure can be confirmed by detecting regions with different luminance in the cross-sectional photograph imaged employing a transmission type electron microscope. Thin sliced toner particle is photographed by a transmission type electron microscope. Namely, it is confirmed that in the toner particle of the present invention, granular domains (phases comprised of crystalline materials and phases comprised of colorants) having different luminance are located in the continuous phase (the phase of the binding resins). Further, based on the results obtained by said electron microscopic observation, factors such as the number of domains in one toner particle, the shape factor of the domain, and the horizontal FERE diameter, which specify the domain-matrix structure in the toner particle, are obtained as numerical figures.

The luminance in the photograph of a transmission electron microscope, as described herein, is formed by visualizing difference in transmittance of the electron beam generated by difference in the crystal state of each element constituting toner particles, namely binding resins, colorants, and crystalline materials. Generally, the colorants are imaged at a low luminance due to their lower electron beam transmittance than the binding resins, while the crystalline materials are imaged at a higher luminance than the binding resins.

Low luminance, as described in electron microscopic photographs, refers to one in 0 to 99 gradations when the luminance signals of pixels are divided into 256 gradations, while medium luminance refers to one in the range of 80 to 160 gradations, and high luminance refers to one in 126 to 255 gradations. However, in the present invention, relative luminance may be taken into account. Namely, when components constituting toner particles are identified utilizing said photographs, the luminance is not always limited to said range. For example, when a sliced sample for transmission type electron microscopy is placed at 80 to 120° C., crystalline materials, which form domains, flow out and are observed as voids. As a result, it is possible to discriminate domains comprised of said crystalline materials from domains comprised of colorants.

As described above, in the present invention, by discriminating each component in toner particles based on said luminance, it is possible to visually identify or discriminate each component utilizing electron microscopic photographs that domains are as domains and a non-domain portion is as the non-domain portion. Herein, by utilizing an image analysis unit installed in said electron microscope, luminance information is converted to image information which can be visually discriminated.

FIG. 1 shows a schematic view showing one example of each of toner particles (a) and (b) comprised of a domain-matrix structure of the present invention. In electron microscopic photographs, as shown in said schematic views, it is observed that the toner particles of the present invention are comprised of a continuous phase and domain portions having different luminance. Further, there are regions with length "a" and depth "b" along the outer circumference of the toner particle, which comprises no domain portions.

The crystalline material constituting said domain portions, as described in the present invention, refers to the organic compound, having a melting point, which is preferably a hydrocarbon having an ester group in its structure. The melting point of the crystalline materials in the toner particles of the present invention is lower than the softening point of the toner and is specifically 130° C. or lower. Said organic compounds preferably comprise an ester group in their structure and include crystalline polyester compounds.

Incidentally, employed as a method to confirm that said crystalline materials, constituting the domain portions, have a melting point, may be DSC, and the fact that said crystalline materials exhibit crystal properties may be confirmed employing means such as an X-ray diffraction apparatus. Further, crystalline materials incorporated into the toner of the present invention include those which exhibit functions as a releasing agent.

The melting point of such crystalline materials is preferably from 50 to 130° C., and is more preferably from 60 to 120° C. It is possible to lower the melt viscosity of toners comprising crystalline materials having a melting point in the range of 50 to 130° C., whereby it is possible to improve adhesion properties to sheets of paper. In addition, even though said crystalline materials are incorporated, excellent off-setting resistance is exhibited due to the fact that the elastic modulus in the high temperature region is maintained in the preferable range.

When the melting point of said crystalline materials is lower than 50° C., the resulting fixability is improved, but the commercial viability is degraded due to degradation of the resulting retaining quality. On the other hand, when the melting point exceeds 130° C., contribution to improvement of fixability decreases due an increase in the minimum melting initiation temperature, whereby fixability improving effects are exhibited to a lesser degree.

The melting point of crystalline materials, as described herein, refers to the value determined employing a differential scanning calorimeter (DSC). Specifically, the temperature, which shows the maximum peak of endothermic peaks which are measured by increasing the temperature from 0 to 200° C. at a rate of 10° C./minute (the first temperature increasing process) is designated as the melting point. Said melting point equals "the endothermic peak, P1 in the first temperature increasing process utilizing DSC".

Listed as the specific apparatus for determining melting points may be DSC-7 manufactured by Perkin-Elmer Corp. The specific method for determining melting points employing said differential scanning calorimeter (DSC) is as follows. After a sample is set aside at 0° C. for one minute, the temperature is raised to 200° C. at a rate of 10° C./minute. The temperature, which exhibits the maxium endothermic peak measured during said opertion, is designated as endothermic peak P1 in the first temperature increasing process. Subsequently, after said sample is set aside at 200° C. for one minute, the temperature is lowered at a rate of 10° C./minute. The temperature, which exhibits the exothermic peak measured during said operation, is designated as exothermic peak P2 during the first cooling process.

In crystalline compounds employed in the toner of the present invention, endothermic peak P1 during the first temperature increasing process, determined by employing DSC, is preferably located from 50 to 130° C., and is more preferably located from 60 to 120° C. Further, exothermic peak P2 during the first cooling process, determined by employing DSC, is preferably located from 30 to 110° C., and is more preferably located from 40 to 120° C. Herein, the relationship of $P1 \geqq P2$ is held between said endothermic peak P1 and exothermic peak P2. Temperature difference, P1–P2 is not particularly limited, but is preferably no more than 50° C.

By incorporating crystalline materials having thermal characteristics as previously described, it is possible to achieve excellent off-setting resistant effects (over a wide fixable temperature range) and excellent fixability (being an enhanced fixing ratio). In order to exhibit the desired effects of the present invention, it is preferable that binding resins and crystalline materials are in a state of phase separation with each other.

Namely, the crystalline materials melt suddenly. As a result, it is possible to decrease the melt viscosity of the entire toner as well as to enhance fixability. Further, due to the fact that they are in a sate of phase separation with each other, off-setting resistance is not degraded because it is possible to retard said decrease in the elastic modulus in the high temperature region.

When said endothermic peak P1 is lower than 50° C., the resultant fixability is improved due to the low melting temperature, but the resultant storage stability is degraded. On the other hand, when said endothermic peak P1 exceeds 130° C., the resultant melting temperature is raised. As a result, it is impossible to improve the fixability as well as the off-setting resistance.

When said exothermic peak P2, which represents a recrystallization state, is lower than 30° C., it is impossible to achieve recrystallization unless cooled to a fairly low temperature, whereby materials having such exothermic peaks are in a low crystallization state. As a result, said materials are not capable of contributing to an improvement of fixability. On the other hand, when said exothermic peak P2 exceeds 110° C., the resultant recrystallization temperature becomes excessively high and the so-called melting temperature is raised. As a result, the resultant fixability at low temperature is degraded.

It is possible to fully observe the structure of a toner particle, employing any of several types of transmission type electron microscopes such as "LEM-2000 Type (manufactured by Topcon Corp.)", which are well known in this industry. In the present invention, projections of at least 100 toner particles were prepared by a factor of 10,000 employing said transmission type electron microscope. Employing the resultant projections, desired values such as the number of domain portions in the interior of a toner are calculated.

In the present invention, imaging employing said transmission type electron microscope is carried out employing the method which is commonly known to measure toner particles. Namely, a specific method for measuring the cross-section of a toner is as follows. After sufficiently dispersing toner particles into an epoxy resin which hardens at normal temperature, they may be buried and hardened. After dispersed into a fine styrene powder having a particle diameter of approximately 100 nm, the resultant dispersion is press-molded. Subsequently, if desired, the resultant block is dyed with triruthenium tetraoxide and triosmium tetraoxide in combination. Thereafter, a thin slice sample is prepared by cutting the resultant block, employing a microtome fitted with a diamond blade. Employing said sliced sample, the cross-sectional structure of toner particles is imaged employing a transmission type electron microscope (TEM). Employing the resultant photographs, the shape of the region of crystalline materials in the toner particles was visually confirmed. At the same time, employing an image processing unit, "Luzex F", manufactured by Nireco Co., Ltd., installed in said electron microscope, the imaged information is processed, and the FERE diameter of the domain portion, the number of domains, and the shape factor in a toner particle are obtained.

The structure of the toner particles of the present invention is specified based on the methods as above. Factors, which specify the structure of the toner particles of the present invention, will now be detailed.

The average of the horizontal FERE diameter of the domain portion in the toner particle of the toner of the present invention is commonly from 200 to 900 nm, is preferably from 300 to 750 mm, and is most preferably from 450 to 700 nm. When the average of the horizontal FERE diameter in the toner particle is less than 200 nm, the resultant toner is not suitable for image formation due to the excessively small amount of the crystalline materials bled from the toner particles. On the other hand, when the average of the horizontal FERE diameter exceeds 900 nm, the resultant charge density on the surface of the toner particle loses its uniformity, which is not preferred for image formation.

Further, the horizontal FERE diameter, as described in the present invention, refers to the length of a toner particle in the horizontal direction when said toner particle is placed on a horizontal plane in the optional state, and the horizontal FERE diameter of the domain portion refers to the length of each domain in the horizontal direction which exists in the interior of said toner particle as placed optionally.

The variation coefficient of the horizontal FERE diameter of an domain portion in the particle of the present invention is commonly no more than 40 percent, is preferably no more than 35 percent, and is more preferably no more than 30 percent. Said variation coefficient of the horizontal FERE diameter of the domain portion of the toner particle of the present invention is obtained employing the formula described below:

$$\text{variation coefficient of horizontal FERE diameter} = (S2/K2) \times 100 \text{ (in percent)}$$

wherein S2 is the standard deviation of the horizontal FERE diameter of 100 domain portions, and K2 is their horizontal FERE diameter average.

In the present invention, the variation coefficient of the horizontal FERE diameter of the domain portion in the toner particle, as described herein, refers to fluctuation of said horizontal FERE diameter average, that is, the fluctuation of the size of each domain of crystalline materials. When said variation coefficient of said horizontal FERE diameter exceeds 40 percent, the size of domains fluctuates markedly. As a result, it is not preferable that the crystalline materials are not capable of forming a uniform releasing agent layer on the fixing member (being a roller or a belt), whereby off-setting toner is formed.

On the other hand, in the present invention, when said variation coefficient remains under 40 percent, the desired effects of the present invention are achieved. Therefore, it is unnecessary to realize "0" of said variation coefficient, namely to result in no variation of the horizontal FERE diameter.

The toner of the present invention is one which comprises at least 99 percent by number of 1 to 20 domains in one toner particle. This implies that in the toner of the present invention, crystalline material particles are incorporated into toner particles without fail. Namely, in conventional toners such as the pulverization toner as well as the suspension polymerization toner disclosed in Japanese Patent Publication Open to Public Inspection No. 5-88409, it has been confirmed that several percent toner particles do not comprise crystalline materials in the particle interior. As noted, it has been extremely difficult to confirm that additives such as releasing agents are incorporated in each toner particle. However, in the toner of the present invention, when the resultant toner is examined, it has been confirmed that crystalline materials are consistently incorporated into all toner particles. For this reason, it is assumed that the toner of the present invention is prepared employing the multi-step polymerization method described below.

The fact that the toner of the present invention comprises at least 99 percent of such toner particles, which comprise from 1 to 20 domains in one toner particle, is obtained by calculating the number of domains (crystalline materials) in one toner particle, utilizing transmission type electron microscopic photographs of 1,000 toner particles followed by obtaining the average of the resultant numbers. In the present invention, the number of domains in one toner particle is commonly from 1 to 20, is preferably from 8 to 18, and is more preferably from 10 to 16. Incidentally, toner, which comprises no domain in toner particles, is not comprised of said domain-matrix structure, and is beyond the present invention. Further, toner, which comprises at least 20 domains in one toner particle, is in a state in which the added amount of the crystalline materials is excessive. As a result, such toner is not desirable from the viewpoint of image formation.

In the toner of the present invention, the average of the shape factor of the domain in the toner particle is commonly in the range of 140 to 220. The shape factor of the domain, as described herein, refers to the numerical value of the domain shape in the toner particle, and the value can be calculated based on the formula described below:

$$\text{shape factor of the domain}=[(\text{maximum length of the domain})^2\times\pi/(\text{area of the domain})\times 4]\times 100$$

The shape factor defined by said formula represents the domain shape, employing the numerical value. An domain having a shape factor of 100 refers to a true circle, while as the shape factor becomes greater, the domain shape becomes longer and narrower. As the shape factor becomes greater then 100, the resultant domain shape varies from a true circle to an oval and then to a needle shape.

Further, in the present invention, employing the variation coefficient of the shape, the fluctuation of the domain shape is quantitatively obtained. The variation coefficient of the domain shape is defined based on the formula described below:

$$\text{variation coefficient of the shape factor } (S3/K3)\times 100 \text{ (in percent)}$$

wherein S3 is the standard deviation of the shape factor of 100 domain portions, and K3 is the average shape factor.

In the present invention, domains having an average shape factor of 140 to 220 have a variation coefficient of no more than 35 percent, and the ratio of those having an average shape factor in the range of 100 to 120 is no more than 10 percent, based on the number of particles, while the ratio of those having an average shape factor of at least 240 is no more than 15 percent, based on the number of particles. Namely, the present invention is based on the discovery that it is possible to control the rate in which crystalline materials bleed to the exterior of the toner particle by specifying the distribution of the shape factor. In the present invention, domains having an average shape factor of 140 to 220 are acceptable if the variation coefficient is no more than 35 percent. A state is not required in which the variation coefficient is 0 percent, namely in domains having an average shape factor of 140 to 220, said domain shape exhibits no fluctuation.

In the present invention, it was discovered that while domains, having a shape factor of 140 to 220, are firmly held without being dislodged from the interior of the toner particle, toner particles effectively bleed crystalline materials out during pressure fixing. The shape of domains, having a shape factor of less than 140, approaches a sphere. As a result, the domains tend to be dislodged from the interior of toner particle. On the other hand, the shape of domains, having a shape factor of 220, elongates. As a result, it tends to be difficult to effectively bleed crystalline materials to the exterior of the toner particles.

However, domains are not preferred in which the average variation coefficient exceeds 35 percent, even though the average shape factor is from 140 to 220; the ratio of the domain in the range of 100 to 120 exceeds 10 percent, based on the number of particles; and the ratio of domains exceeding 240 exceeds 15 percent, based on the number of particles. In those cases, even though said domains are not dislodged from the toner particle and crystalline materials are effectively bled out, the shape of domains markedly becomes non-uniform, and the ratio of domains, which tend to be dislodged from the domain, increases, or the ratio of the domains, which are not capable of effectively bleeding crystalline materials out, increases, whereby upon forming images, desired effects as the releasing agents tend not to be exhibited. As a result, it becomes difficult to obtain the effects which have been discovered by the present invention.

The domains in the toner particle of the present invention have shapes as described above. The variation coefficient of domain having an average shape factor of 160 to 200 is more preferably no more than 35 percent; the ratio of the domain having an average shape factor of 100 to 120 is no more than 5 percent, based on the number of particles; and the ratio of the domain having an average shape factor of at least 240 is no more than 10 percent, based on the number of particles.

In toner particles comprised of the domain-matrix structure of the present invention, domain portions are comprised of crystalline materials, as previously described. In addition, some colorants are incorporated into the toner particle upon forming colorant domains. Said colorant domains are shown as Domain B in FIG. 1. The luminance of domains comprised of crystalline materials is different from that of domains comprised of said colorants. As a result, it is possible to discriminate them in electron microscopic photographs. Incidentally, the present invention specifies the domain portion in the domain-matrix structure in the toner particle, utilizing various kinds of parameters, and the domains comprised of crystalline materials are specified employing the aforesaid horizontal FERE diameter, the number of particles, and the shape factor of domains. On the other hand, the domains comprised of colorants are specified based on the area of the Voronoi polygon described below.

In the present invention, regarding the domain portion in the domain-matrix structure of the toner particle, various numeral characteristic values can be calculated. These values are calculated utilizing an image analysis unit fitted with an electron microscope, based on the image information observed by said electron microscope.

Figure 2:
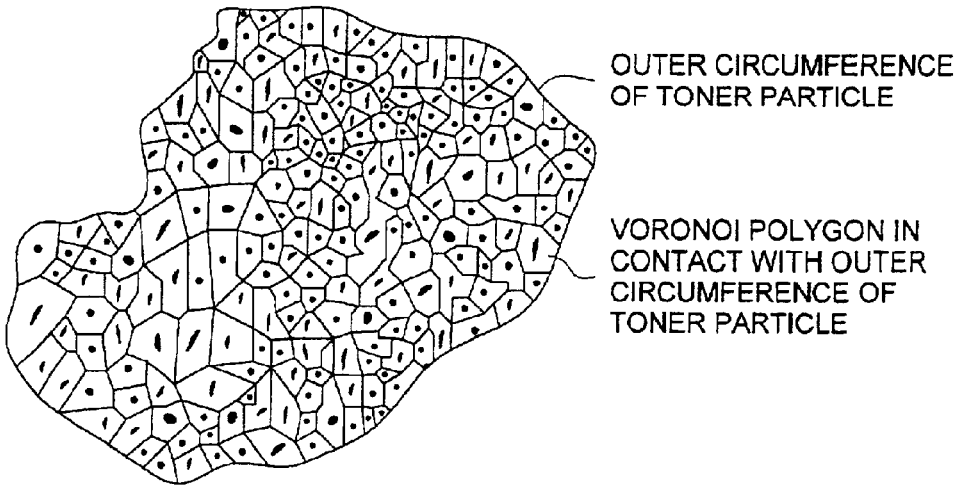
FIG. 2 is a schematic view of the toner particle comprised of a domain-matrix structure of the present invention, which is divided by Voronoi polygons.

The area of the Voronoi polygon employed in the present invention, as described herein, refers to the domain portion occupying state in the toner particle. The Voronoi polygon or Voronoi polyhedron, as described herein, is as follows. As described in, for example, "Iwanami Rikagaku Jiten (Iwanami Physical and Chemical Dictionary)", when many points are scattered in a space or on a plane, the whole space or the whole plane is divided into polyhedrons or polygons by creating a perpendicular bisecting plane or a perpendicular bisecting line of the adjacent points. The polyhedron formed as above is called Voronoi polyhedron, while the polygon formed as above is called Voronoi polygon. Such division of said space as well as said plane is called Voronoi division. FIG. 2 shows one example of the toner particle of the present invention which is divided by a Voronoi polygons.

As described above, in the present invention, as the scale showing the domain portion occupying ratio in the toner particle, the domain portion occupying state in the domain-matrix structure of the toner particle is shown employing the area of the Voronoi polygon obtained by said Voronoi division. Namely, in the present invention, the center of gravity of the domain in the toner particle is focused on, and a polygon is formed employing a perpendicular bisecting line between the centers of gravity of adjacent domains. These polygon areas are calculated based on photographs obtained employing a transmission type electron microscope while employing the image analysis device installed in said transmission type electron microscope.

A large Voronoi polygonal area indicates that the distance between the centers of gravity of adjacent domains is large. Namely, it indicates that the domain portion occupying state of in the particle is not dense. On the other hand a small Voronoi area indicates that the distance between the centers of gravity of adjacent domains is short. Namely it indicates that the domain occupying state in the particle is in a dense state. In the present invention, the Voronoi polygons of 1,000 toner particles were determined and the average value were calculated.

Incidentally, the Voronoi polygon is generally and mathematically defined employing the formula described below.

<Area of Voronoi Polygon>

The set of Voronoi polygon V(i) regarding N independent point P(i) ($1 \leqq i \leqq N$) in two-dimensional space R2 or three-dimensional space R3 is:

$$V(i)=\{X \mid |X-P(i)|<|X-P(j)| \text{ for all } i \text{ and } j\}$$

wherein X and P each represent the position vector and || represents the distance in Euclidean space.

V(i) as defined above assumes that in R2, a Voronoi polygon is formed, and in R3, a Voronoi polyhedron is formed. When V(i) is directly adjacent to V(j), it is defined that the boundary between Voronoi polygons becomes one part of the perpendicular bisecting line connecting point P(i) with point P(j). Said Euclidean space equals one which is defined and described in "Suurikagaku Daijiten (Mathematical Science Encyclopedia)".

Further, the center of gravity of the toner particle of the present invention, as well as the center of gravity of each domain in the toner particle is obtained employing the moment of images, which is automatically calculated by the image analysis device installed in said transmission type electron microscope. Herein, the coordinates of the center of gravity of the toner particle are obtained as follows. The product of the luminance of a minute area at an optional point of the toner particle, and the coordinates of said optimal point are obtained. Further, regarding all the coordinates in which all toner particles exist, the product of the luminance and the coordinate values is obtained. Then, the coordinates of the center of gravity are obtained by dividing the sum of the resulting products by the luminance of the toner particle (the sum of the luminance at each coordinate point obtained as above). Further, the center of gravity of the domain is obtained in the same manner as above by obtaining the luminance at an optional coordinate point in the domain. As noted, the coordinates of the center of gravity of the toner particle of the present invention, as well as the coordinates of the of center of gravity of each domain in the toner particle are calculated based on the luminance at each of the optional points. Namely, said coordinates are calculated based on the brightness and darkness of images.

In the present invention, the average area of the Voronoi polygon formed by the perpendicular bisecting line between the centers of gravity of domains, which are directly adjacent to each other in the toner particle, is from 20,000 to 120,000 $nm^2$, and the variation coefficient of the average of said area is no more than 25 percent. The variation coefficient of the area of the Voronoi polygon in the present invention is calculated based on the formula below:

$$\text{variation coefficient of the area of the Voronoi polygon}=(S4/K4)\times 100 \text{ (in percent)}$$

wherein S4 is the standard deviation of the area of the Voronoi polygon in the toner particle, and K4 is the average area of the Voronoi polygon.

Further, the average area of the Voronoi polygons, which are adjacent to each other, is preferably from 40,000 to 100,000 $nm^2$, and its variation coefficient is no more than 20 percent.

The average area of the Voronoi polygon formed by the perpendicular bisecting line between the centers of gravity of the domains, which are adjacent to each other in the toner particle of the present invention, is in the range of 20,000 to 120,000 $nm^2$. When the average is beyond said range, the domain occupying state in the toner particle becomes unacceptable. For example, said fact indicates that colorants which exist as an domain in the particle is not effectively incorporated into the toner particle. As a result, it is not preferable because it is difficult to discern the effects of the present invention.

The variation coefficient of the average area of the Voronoi polygon formed by domains which are adjacent to each other, as described herein, specifies the fluctuation of the area of the Voronoi polygon, namely it specifies the fluctuation of the domain portion occupying state in the toner particle. The variation coefficient of the average area of the Voronoi polygon is commonly in the range of no more than 25 percent, and is preferably in the range of no more than 20 percent. Incidentally, it is not required that the variation coefficient be 0 percent, namely, the state in which the average area of the Voronoi polygon results in no fluctuation, or in other words, any toner particle being in the same domain occupying state.

In the present invention, it is not preferable that the variation coefficient of the average area of the Voronoi polygon exceeds 25 percent, because the fluctuation among the areas of the resulting Voronoi polygons becomes excessively large, making it extremely difficult to discern the effects of the present invention during image formation.

Further, in the present invention, it is characterized that the non-domain portion of the Voronoi polygon formed by the domain, which is located within the specified range from the center of gravity of the toner particle, is smaller than that of the Voronoi polygon which is formed by the domain beyond said range. Namely, in the present invention, the average area of the Voronoi polygon formed by an domain, which is located beyond the radius 1,000 nm circle having its center at the center of gravity of the toner particle, is greater than that of the area of the Voronoi polygon formed by an domain which is located in said 1,000 nm radius circle. This fact implies that in the toner particle, domains are sparsely scattered in the area somewhat farther from the center of gravity of the toner particle. By satisfying said conditions, in the toner of the present invention, the domains are suitably scattered in the toner particle so that the effects, which are obtained by achieving the present invention, are evident.

Still further, in the present invention, there are 5 to 30 domains having an area of Voronoi polygons of at least 160,000 $nm^2$ in one toner particle. Said fact implies that those domains are suitably scattered so that each domain is suitably positioned so as to maintain the desired distance. This also means that said domains are not locally positioned and colorants are effectively incorporated into the toner particle.

Further, in the toner of the present invention, the toner particle is comprised of a domain-matrix structures, but has regions, in which no domains are located, in the region along the outer circumference. In the schematic views in FIGS. Toner Particle (a) and Toner Particle (b), the region, which is shown by the length of "a" and the depth of "b" along the outer circumference of the cross-section of the toner particle, comprises no domains. Namely, in the toner of the present invention, it is confirmed that in the region along the outer circumference of the cross-section of the toner particle, said toner comprises regions which do not comprise an domain portion having a depth of 100 to 200 nm and a length of 500 to 6,000 nm.

In the present invention, it is assumed that the absence of domains in the specified regions along the outer circumference of the toner particle specifically contributes to effectively minimizing dislodging of domains from the toner particle. Further, it is also assumed that said absence of domains functions to suitably disperse crystalline materials as well as colorants into the interior of the particle, and to effectively bleed said crystalline materials out during pressure fixing.

Employing said transmission type electron microscope, it was found that the toner of the present invention was comprised of a domain-matrix structure. Crystalline materials incorporated into the toner particle form domains thereof, while colorants incorporated into the toner particle form different domains thereof. As noted, a plurality of kinds of domains is formed for each kind of additives. The characteristics described above are those of the same kind, namely between domains comprised of crystalline materials or comprised of colorants, and are not those between different kinds of domains.

Domains comprised of different additives, namely domains comprised of crystalline materials and domains comprised of colorants result in different luminance. As a result, they may be easily discriminated utilizing electron microscopic photographs. Further, conditions are set so that said image analysis device does not erroneously calculate the characteristic values between different domains. Regarding domains in the toner particle of the present invention, domains comprised of crystalline materials utilize specific FERE diameters, shape factors of the domains, and the number of domains per toner particle, while the domain comprised of colorants utilize specific areas of the Voronoi polygon.

Further, the non-domain portion of the toner particle comprised of said domain-matrix structure of the present invention is comprised of resins.

The toner employed in the invention is detailed.

The toner having a variation coefficient of the toner shape coefficient of not more than 16 percent, as well as having a number variation coefficient in the is preferably employed because high image quality, which is exhibited by excellent cleaning properties, as well as excellent fine line reproduction, can be obtained over an extended period of time.

The inventor has found that a corner part of the toner particle becomes round during long time usage in the developing apparatus and the rounded part accelerates the additives embedded in the toner particle, whereby charging amount varies, and fluidity and cleaning ability are reduced.

Further, by employing a toner in which the number ratio of toner particles, having no corners, is set at 50 percent and the number variation coefficient in the number size distribution is adjusted to not more than 27 percent, it is possible to obtain high image quality over an extended time of period, which exhibits excellent cleaning properties, as well as excellent fine line reproduction.

The polymerized toner, which is preferably employed in the present invention, has a number ratio of toner particles having a shape coefficient of 1.2 to 1.6 and is at least 65 percent, and further the variation coefficient of said shape coefficient is not more than 16 percent. And it is possible to obtain high image quality over an extended time of period, which exhibits excellent cleaning properties, as well as excellent fine line reproduction.

The number particle size distribution as well as the number variation coefficient of the toner of the present invention are measured by either a Coulter Counter TA-II or a Coulter Multisizer (both are manufactured by Coulter Co.). In the present invention, the Coulter Multisizer was used, which was connected to a particle size distribution output interface (manufactured by Nikkaki), via a personal computer. An aperture employed in said Coulter Multisizer was 100 $\mu$m, and the volume as well as the number of toner particles with at least 2 $\mu$m was measured to calculate the particle size distribution as well as the average particle diameter. The number particle size distribution as described herein represents the relative frequency of toner particles with respect to the toner diameter, and the number average particle diameter represents the median diameter in the number particle size distribution, that is Dn50.

The number variation coefficient in the number particle size distribution of toner is calculated by the formula described below:

$$\text{Number variation coefficient}=(S/Dn)\times 100 \text{ (in percent)}$$

wherein S represents the standard deviation in the number particle size distribution, and $D_n$ represents the number average particle diameter (in $\mu$m).

The number variation coefficient of the toner of the present invention is generally not more than 27 percent, and is preferably not more than 25 percent. By controlling the number variation coefficient to be below 27 percent, voids in the transferred toner layer decrease to improve fixing property as well as to minimize offsetting. Further, the charge distribution narrows, and the transfer efficiency is enhanced, improving image quality.

Methods to control the number variation coefficient of the present invention are not particularly limited. For example, a method may be employed in which toner particles are classified employing forced airflow. However, in order to decrease the number variation coefficient, classification in liquid is more effective. Classifying methods in liquid include one in which a toner is prepared by classifying and collecting toner particles in response to the difference in sedimentation rate generated by the difference in particle diameter while controlling rotational frequency, employing a centrifuge.

The shape coefficient of the toner particles will be detailed. It is preferable the ratio of toner particles having a shape coefficient of 1.2 to 1.6 is 65 percent by number and variation coefficient of said shape coefficient is 16 percent. The shape coefficient of the toner particles is expressed by the formula described below and represents the roundness of toner particles.

$$\text{Shape coefficient } [(\text{maximum diameter}/2)^2\times\pi]/\text{projection area}$$

wherein the maximum diameter means the maximum width of a toner particle obtained by forming two parallel lines between the projection image of said particle on a plane, while the projection area means the area of the projected image of said toner on a plane. The shape coefficient was determined in such a manner that toner particles were photographed under a magnification factor of 2,000, employing a scanning type electron microscope, and the resultant photographs were analyzed employing "Scanning Image Analyzer", manufactured by JEOL LTD. At that time, 100 toner particles were employed and the shape coefficient was obtained employing the aforementioned calculation formula.

Figure 7:
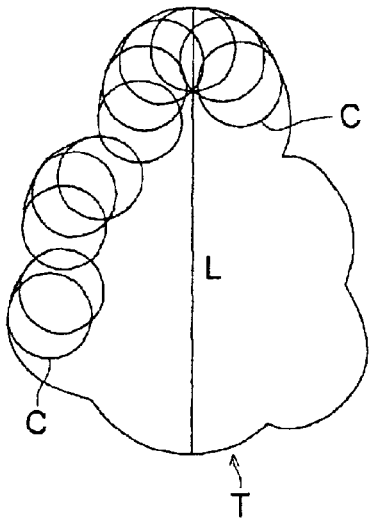
FIG. 7 is a schematic view explaining a toner having either corners or no corners.
Figure 7:
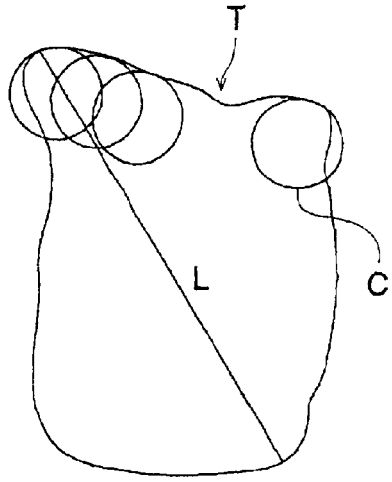
Figure 7:
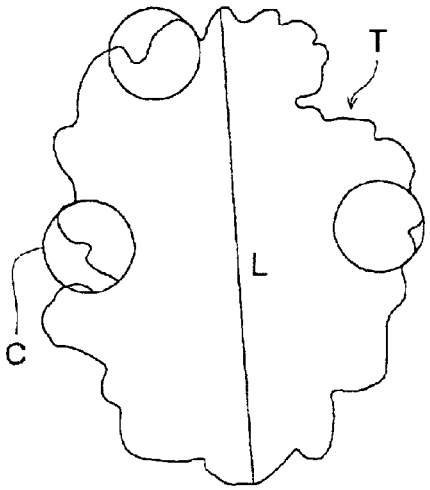

The toner particles of the present invention, which substantially have no corners, as described herein, mean those having no projection to which charges are concentrated or which tend to be worn down by stress. Namely, as shown in FIG. 7(*a*), the main axis of toner particle T is designated as L. Circle C having a radius of L/10, which is positioned in toner T, is rolled along the periphery of toner T, while remaining in contact with the circumference at any point. When it is possible to roll any part of said circle without substantially crossing over the circumference of toner T, a toner is designated as "a toner having no corners". "Without substantially crossing over the circumference" as described herein means that there is at most one projection at which any part of the rolled circle crosses over the circumference.

Further, "the main axis of a toner particle" as described herein means the maximum width of said toner particle when the projection image of said toner particle onto a flat plane is placed between two parallel lines. Incidentally, FIGS. 7(*b*) and 7(*c*) show the projection images of a toner particle having corners.

Toner having no corners was measured as follows. First, an image of a magnified toner particle was made employing a scanning type electron microscope. The resultant picture of the toner particle was further magnified to obtain a photographic image at a magnification factor of 15,000. Subsequently, employing the resultant photographic image, the presence and absence of said corners was determined. Said measurement was carried out for 100 toner particles.

In the toner of the present invention, the ratio of the number of toner particles having no corners is generally at least 50 percent, and is preferably at least 70 percent. By adjusting the ratio of the number of toner particles having no corners to at least 50 percent, the formation of fine toner particles and the like due to stress with a developer conveying member and the like tends not to occur. Thus it is possible to minimize the formation of a so-called toner which excessively adheres to the developer conveying member, and simultaneously minimizes staining onto said developer conveying member, as well as to narrow the charge amount distribution. Thus, since the charge amount distribution is narrowed, it is possible to stabilize chargeability, resulting in excellent image quality over an extended period of time.

The toner having no corners can be obtained by various methods. For example, as previously described as the method to control the shape coefficient, it is possible to obtain toner having no corners by employing a method in which toner particles are sprayed into a heated air current, a method in which toner particles are subjected to application of repeated mechanical force, employing impact force in a gas phase, or a method in which a toner is added to a solvent which does not dissolve said toner and which is then subjected to application of revolving current.

The toner of the present invention preferably has a sum M of at least 70 percent. Said sum M is obtained by adding relative frequency m1 of toner particles, included in the most frequent class, to relative frequency m2 of toner particles included in the second frequent class in a histogram showing the particle diameter distribution, which is drawn in such a manner that natural logarithm lnD is used as an abscissa, wherein D (in $\mu$m) represents the particle diameter of a toner particle, while being divided into a plurality of classes at intervals of 0.23, and the number of particles is used as an ordinate.

By maintaining the sum M of the relative frequency m1 and the relative frequency m2 at no less than 70 percent, the variance of the particle diameter distribution of toner particles narrows. As a result, by employing said toner in an image forming process, the minimization of generation of selective development may be secured.

In the present invention, the above-mentioned histogram showing the particle diameter distribution based on the number of particles is one in which natural logarithm lnD (wherein D represents the diameter of each particle) is divided at intervals of 0.23 into a plurality of classes (0 to 0.23, 0.23 to 0.46, 0.46 to 0.69, 0.69 to 0.92, 0.92 to 1.15, 1.15 to 1.38, 1.38 to 1.61, 1.61 to 1.84, 1.84 to 2.07, 2.07 to 2.30, 2.30 to 2.53, 2.53 to 2.76 . . . ), being based on the number of particles. Said histogram was prepared in such a manner that particle diameter data of a sample measured by a Coulter Multisizer according to conditions described below were transmitted to a computer via an I/O unit, so that in said computer, said histogram was prepared employing a particle diameter distribution analyzing program.

(Measurement Conditions)

Aperture: 100 $\mu$m

Sample preparation method: added to 50 to 100 ml of an electrolytic solution (ISOTON R-11, manufactured by Coulter Scientific Japan Co) is a suitable amount of a surface active agent (a neutral detergent) and stirred. Added to the resulting mixture is 10 to 20 mg of a sample to be measured. To prepare the sample, the resulting mixture is subjected to dispersion treatment for one minute employing an ultrasonic homogenizer.

Number of fine toner particles having strong adhesion which fly to heating device and generate off-set is reduced, and high transfer performance is obtained whereby image quality of half tone, fine line, dot and so on is improved by employing the toner having average diameter of 3 to 9 $\mu$m, preferably 4.5 to 8.5 $\mu$m and more preferably 5 to 8 $\mu$m. Particle diameter is controlled by adjusting concentration of coagulant (salting agent), amount of organic solvent, fusing time, composition of polymer during the toner preparation.

The transfer efficiency is improved, half-tone image quality, and fine line or dot image quality is improved by employing the toner having number average diameter of 3 to 9 $\mu$m. It is possible to determine said volume average particle diameter of toner particles, employing a Coulter Counter TA-II, a Coulter Multisizer, SLAD 1100 (a laser diffraction type particle diameter measuring apparatus, produced by Shimadzu Seisakusho), and the like.

(Producing Method of Toner)

The resin particles of the toner can be produced by preparing resin particles by polymerization of polymeric monomer in an aqueous medium. The methods include a process preparing particles by a suspension polymerization method, or an emulsion polymerization method or a mini-emulsion polymerization method and then salting out/coagulating.

Suspension Polymerization

When the toner is produced by the suspension polymerization method, the production is performed by the following procedure. Various raw materials such as a colorant, a mold releasing agent according to necessity, a charge controlling agent and a polymerization initiator are added into a polymerizable monomer and dispersed or dissolved by a homogenizer, a sand mill, a sand grinder or a ultrasonic dispersing apparatus. The polymerizable monomer in which the raw materials are dissolved or dispersed is dispersed into a form of oil drops having a suitable size as toner particle by a homo-mixer or a homogenizer in an aqueous medium containing a dispersion stabilizing agent. Then the dispersion is moved into a reaction vessel having a stirring device with double stirring blades, and the polymerization reaction is progressed by heating. After finish of the reaction, the dispersion stabilizing agent is removed from the polymer particles and the polymer particles are filtered, washed and dried to prepare a toner. In the invention, the "aqueous medium" is a medium containing at least 50% by weight of water.

Emulsion Polymerization and Mini-Emulsion Polymerization

The toner according to the invention can be also obtained by salting-off/coagulating resin particles prepared by the emulsion polymerization or the mini-emulsion polymerization.

For example, the methods described in JP O.P.I. Nos. 5-265252, 6-329947 and 9-15904 are applicable. The toner can be produced by a method by which dispersed particles of constituting material such as resin particles and colorant or fine particles constituted by resin and colorant are associated several by several. Such the method is realized particularly by the following procedure: the particles are dispersed in water and the particles are salted-out by addition of a coagulation agent in an amount of larger than the critical coagulation concentration. At the same time, the particles are gradually grown by melt-adhesion of the particles by heating at a temperature higher than the glass transition point of the produced polymer. The particle growing is stopped by addition of a large amount of water when the particle size is reached at the prescribed diameter. Then the surface of the particle is made smooth by heating and stirring to control the shape of the particles. The particles containing water in a fluid state are dried by heating. Thus the toner can be produced. In the foregoing method, an infinitely water-miscible solvent such as alcohol may be added together with the coagulation agent.

The toner particles are prepared by a process of salting/coagulation of fine particles obtained by polymerization and a colorant. A crystalline material is incorporated in polymerizable monomer liquid in a melted or dissolved state during at least a part of the polymerization process.

The toner according to the invention can be also obtained by salting-off/coagulating resin particles prepared by the emulsion polymerization or the mini-emulsion polymerization.

The production process comprises, for example, the following processes:

1. A multi-step polymerizing process
2. A salting-out/coagulation process to produce a toner particle by salting-out/coagulating the compound resin particles and colored particles
3. Filtering and washing processes to filter the toner particles from the toner particle dispersion and to remove a unnecessary substance such as the surfactant from the toner particles
4. A drying process to dry the washed toner particles
5. A process to add an exterior additive to the toner particles Each of the processes is described below.

(Multi-Step Polymerization Process)

The multi-step polymerization process is a process for preparing the composite resin particle having broader molecular weight distribution so as to obtain enhanced anti-off-set characteristics. A plural of polymerization reaction is conducted in separate steps so that each particle has different layers having different molecular weight. The obtained particle has a gradiant of molecular weight from the center to the surface of the particle. For example, a lower molecular weight surface layer is formed by adding a polymerizable monomer and a chain transfer agent after obtaining a higher molecular weight polymer particles dispersion.

It is preferred from the viewpoint of the stability and the anti-crush strength of the obtained toner to apply the multi-step polymerization including three or more polymerization steps. The two- and tree-step polymerization methods, which are representative examples, are described below. It is preferable that the closer to the surface the molecular weight is lower in view of the anti-crush strength.

(Two-Step Polymerization Method)

The two-step polymerization method is a method for producing the composite resin particle comprised of the central portion (core) containing the crystalline material comprising the high molecular weight resin and an outer layer (shell) comprising the low molecular weight resin.

In concrete, a monomer liquid is prepared by incorporating the crystalline material in a monomer, the monomer liquid is dispersed in an aqueous medium (an aqueous solution of a surfactant) in a form of oil drop, and the system is subjected to a polymerization treatment (the first polymerization step) to prepare a dispersion of a higher molecular weight resin particles each containing the crystalline material.

Next, a polymerization initiator and a monomer to form the lower molecular weight resin is added to the suspension of the resin articles, and the monomer L is subjected to a polymerization treatment (the second polymerization step) to form a covering layer composed of the lower molecular weight resin (a polymer of the monomer) onto the resin particle.

(Three-Step Polymerization Method)

The three-step polymerization method is a method for producing the composite resin particle comprised of the central portion (core) comprising the high molecular weight resin, the inter layer containing the crystalline material and the outer layer (shell) comprising the low molecular weight resin.

In concrete, a suspension of the resin particles prepared by the polymerization treatment (the first polymerization step) according to a usual procedure is added to an aqueous medium (an aqueous solution of a surfactant) and a monomer liquid prepared by incorporating the crystalline material in a monomer is dispersed in the aqueous medium. The aqueous dispersion system is subjected to a polymerization treatment (the second polymerization step) to form a covering layer (inter layer) comprising a resin (a polymer of the monomer) containing the crystalline material onto the surface of the resin particle (core particle). Thus a suspension of combined resin (higher molecular weight resin-middle molecular weight resin) particles is prepared.

Next, a polymerization initiator and a monomer to form the lower molecular weight resin is added to the dispersion of the combined resin particles, and the monomer is subjected to a polymerization treatment (the third polymerization step) to form a covering layer composed of the low molecular weight resin (a polymer of the monomer) onto the composite resin particle.

In the three-step polymerization method, the crystalline material can be finely and uniformly dispersed by applying a procedure, at the time of forming the inter layer on the resin particle.

The polymer is preferably obtained by polymerization in the aqueous medium. The crystalline material is incorporated in a monomer, and the obtained monomer liquid is dispersed in the aqueous medium as oil drop at the time of forming resin particles (core) or covering layer thereon (inter layer) containing the crystalline material, and resin particles containing a releasing agent can be obtained as latex particles by polymerization treatment with the addition of initiator.

The water based medium means one in which at least 50 percent, by weight of water, is incorporated.

Herein, components other than water may include water-soluble organic solvents. Listed as examples are methanol, ethanol, isopropanol, butanol, acetone, methyl ethyl ketone, tetrahydrofuran, and the like. Of these, preferred are alcohol based organic solvents such as methanol, ethanol, isopropanol, butanol, and the like which do not dissolve resins.

Methods are preferred in which dispersion is carried out employing mechanical force. Said monomer solution is preferably subjected to oil droplet dispersion (essentially an embodiment in a mini-emulsion method), employing mechanical force, especially into water based medium prepared by dissolving a surface active agent at a concentration of lower than its critical micelle concentration. An oil soluble polymerization initiator may be added to the monomer solution in place of a part or all of water soluble polymerization initiator.

In the usual emulsion polymerization method, the crystalline material dissolved in oil phase tends to desorb. On the other hand sufficient amount of the crystalline material can be incorporated in a resin particle or covered layer by the mini-emulsion method in which oil droplets are formed mechanically.

Herein, homogenizers to conduct oil droplet dispersion, employing mechanical forces, are not particularly limited, and include, for example, "Clearmix", ultrasonic homogenizers, mechanical homogenizers, and Manton-Gaulin homogenizers and pressure type homogenizers.

The diameter of dispersed particles is 10 to 1,000 nm, and is preferably 30 to 300 nm. Phase structure of crystalline material in a toner particle, namely the FPRE diameter, the shape coefficient and variation coefficient thereof, may be controlled by broadening the distribution of dispersion particle diameter.

Emulsion polymerization, suspension polymerization seed emulsion etc. may be employed as the polymerization method to form resin particles or covered layer containing the crystalline material. These polymerization methods are also applied to forming resin particles (core particles) or covered layer which do not contain the crystalline material.

The particle diameter of composite particles obtained by the process (1) is preferably from 10 to 1,000 nm in terms of weight average diameter determined employing an electrophoresis light scattering photometer "ELS-800" (produced by Ohtsuka Denshi Co.).

Glass transition temperature (Tg) of the composite resin particles is preferably from 48 to 74° C., and more preferably from 52 to 64° C. The Softening point of the composite resin particles is preferably from 95 to 140° C.

<Salting-Out/Fusion Process>

Salting-out/fusion process is a process to obtain toner particles having undefined shape (aspherical shape) in which the composite resin particles obtained by the foregoing process and colored particles are aggregated.

Salting-out/fusion process of the invention is that the processes of salting-out (coagulation of fine particles) and fusion (distinction of surface between the fine particles) occur simultaneously, or the processes of salting-out and fusion are induced simultaneously. Particles (composite resin particles and colored particles) must be subjected to coagulation in such a temperature condition as lower than the glass transition temperature (Tg) of the resin composing the composite resin particles so that the processes of salting-out (coagulation of fine particles) and fusion (distinction of surface between the fine particles) occur simultaneously.

Particles of additives incorporated within toner particles such as a charge control agent (particles having average diameter from 10 to 1,000 nm) may be added as well as the composite resin particles and the colored particles in the salting-out/fusion process. Surface of the colored particles may be modified by a surface modifier.

(Digestion Process)

The digestion process is a process following to the salting-out/fusion process, wherein the crystalline material is subjected to phase separation by continuing agitation with constant strength keeping temperature close to the melting point of the crystalline material, preferably plus minus 20 centigrade of the melting point, after the coagulation of fine particles. The FERE diameter, the shape coefficient and variation coefficient thereof, may be controlled in this process.

The colored particles are subjected to salting out/fusion process in a state that they are dispersed in water based medium. The water based medium to disperse the colored particles includes an aqueous solution dissolving a surfactant in concentration not less than critical micelle concentration (CMC).

Homogenizers employed in the dispersion of the colored particles include, for example, "Clearmix", ultrasonic homogenizers, mechanical homogenizers, and Manton-Gaulin homogenizers and pressure type homogenizers.

In order to simultaneously carry out salting-out and fusion, it is required that salting agent (coagulant) is added to the dispersion of composite particles and colored particles in an amount not less than critical micelle concentration and they are heated to a temperature of the glass transition temperature (Tg) or higher of the resin constituting composite particles.

Suitable temperature for salting out/fusion is preferably from (Tg plus 10° C.) to (Tg plus 50° C.), and more preferably from (Tg plus 15° C.) to (Tg plus 40° C.).

An organic solvent which is dissolved in water infinitely may be added in order to conduct the salting out/fusion effectively.

Further, in the present invention, after preparing colored particles (in the present invention, called toner particles) upon salting out, aggregating, and coalescing resin particles and colorants in a water based medium, separation of said toner particles from said water based medium is preferably carried out at a temperature of not lower than the Krafft point of the surface active agents in said water based medium, and is more preferably carried out in the range of said Krafft point to said Karfft point plus 20° C.

The Krafft point, as described herein, refers to the temperature at which an aqueous solution comprising a surface active agent starts to become milky-white. The Krafft point is measured as follows.

<<Measurement of Krafft Point>>

A solution is prepared by adding a coagulant in a practically employed amount to a water based medium employed in salting-out, aggregation, and coalescence processes, namely a surface active agent solution. The resulting solution is stored at 1° C. for 5 days. Subsequently, the resulting solution is heated while stirring until it becomes transparent. The temperature, at which said solution becomes transparent, is defined as its Krafft point.

From the viewpoint of minimizing excessive static charge to toner particles and providing uniform static-charge buildup to said toner particles, particularly in order to stabilize static-charge buildup against ambience, as well as to maintain the resulting static-charge buildup, the electrostatic image developing toner of the present invention preferably comprises the aforesaid metal elements (listed as such forms are metals and metal ions) in an amount of 250 to 20,000 ppm in said toner and more preferably in an amount of 800 to 5,000 ppm.

Further, in the present invention, the total concentration of divalent (or trivalent) metal elements employed in coagulants and univalent metal elements added as coagulation inhibiting agents, described below, is preferably from 350 to 35,000 ppm. It is possible to obtain the residual amount of metal ions in toner by measuring the intensity of fluorescent X-rays emitted from metal species of metal salts (for example, calcium derived from calcium chloride) employed as coagulants, employing a fluorescence X-ray analyzer "System 3270 Type" (manufactured by Rigaku Denki Kogyo Co., Ltd.). One specific measurement method is as follows. A plurality of toners comprising coagulant metal salts, whose content ratios are known, are prepared, and 5 g of each toner is pelletized. Then, the relationship (a calibration curve) between the content ratio (ppm by weight) of said coagulant metal salts and the fluorescent X-ray intensity (being its peak intensity) is obtained. Subsequently, a toner (a sample), whose content ratio of the coagulant metal salt is to be measured, is pelletized in the same manner and fluorescent X-rays emitted from the metal species of said coagulant metal salt is measured, whereby it is possible to obtain the content ratio, namely "residual amount of metal ions in said toner".

(Filtration and Washing Process)

In said filtration and washing process, filtration is carried out in which said toner particles are collected from the toner particle dispersion, and washing is also carried out in which additives such as surface active agents, salting-out agents, and the like, are removed from the collected toner particles (a cake-like aggregate).

Herein, filtering methods are not particularly limited, and include a centrifugal separation method, a vacuum filtration method which is carried out employing Buchner funnel and the like, a filtration method which is carried out employing a filter press, and the like.

(Drying Process)

This process is one in which said washed toner particles are dried.

Listed as dryers employed in this process may be spray dryers, vacuum freeze dryers, vacuum dryers, and the like. Further, standing tray dryers, movable tray dryers, fluidized-bed layer dryers, rotary dryers, stirring dryers, and the like are preferably employed.

It is proposed that the moisture content of dried toners is preferably not more than 5 percent by weight, and is more preferably not more than 2 percent by weight.

Further, when dried toner particles are aggregated due to weak attractive forces among particles, aggregates may be subjected to crushing treatment. Herein, employed as crushing devices may be mechanical a crushing devices such as a jet mill, a Henschel mixer, a coffee mill, a food processor, and the like.

The toner according to the invention is preferably produced by the following procedure, in which the compound resin particle is formed in the presence of no colorant, a dispersion of the colored particles is added to the dispersion of the compound resin particles and the compound resin particles and the colored particles are salted-out and coagulated.

In the foregoing procedure, the polymerization reaction is not inhibited since the preparation of the compound resin particle is performed in the system without colorant. Consequently, the anti-offset property is not deteriorated and contamination of the apparatus and the image caused by the accumulation of the toner is not occurred.

Moreover, the monomer or the oligomer is not remained in the toner particle since the polymerization reaction for forming the compound resin particle is completely performed. Consequently, any offensive odor is not occurred in the fixing process by heating in the image forming method using such the toner.

The surface property of thus produced toner particle is uniform and the charging amount distribution of the toner is sharp. Accordingly, an image with a high sharpness can be formed for a long period. The anti-offset and anti-winding properties can be improved and an image with suitable glossiness can be formed while a suitable adhesiveness or a high fixing strength with the recording material or recording paper or image support in the image forming method including a fixing process by contact heating by the use of such the toner which is uniform in the composition, molecular weight and the surface property of the each particles.

Each of the constituting materials used in the toner producing process is described in detail below.

(Polymerizable Monomer)

A hydrophobic monomer is essentially used as the polymerizable monomer for producing the resin or binder used in the invention and a cross-linkable monomer is used according to necessity. As is described below, it is preferable to contain at least one kind of a monomer having an acidic polar group and a monomer having a basic polar group.

Hydrophobic Monomer

The hydrophobic monomer can be used, one or more kinds of which may be used for satisfying required properties.

Specifically, employed may be aromatic vinyl monomers, acrylic acid ester based monomers, methacrylic acid ester based monomers, vinyl ester based monomers, vinyl ether based monomers, monoolefin based monomers, diolefin based monomers, halogenated olefin monomers, and the like.

Listed as aromatic vinyl monomers, for example, are styrene based monomers and derivatives thereof such as styrene, o-methylstyrene, m-methylstyrene, p-methylstyrene, p-methoxystyrene, p-phenylstyrene, p-chlorostyrene, p-ethylstyrene, p-n-butylstyrene, p-tert-butylstyrene, p-n-hexylstyrene, p-n-octylstyrne, p-n-nonylstyrene, p-n-decylstyrene, p-n-dodecylstyrene, 2,4-dimethylstyrne, 3,4-dichlorostyrene, and the like.

Listed as acrylic acid ester bases monomers and methacrylic acid ester monomers are methyl acrylate, ethyl acrylate, butyl acrylate, 2-ethylhexyl acrylate, cyclohexyl acrylate, phenyl acrylate, methyl methacrylate, ethyl methacrylate, butyl methacrylate, hexyl methacrylate, 2-ethylhexyl methacrylate, ethyl β-hydroxyacrylate, propyl γ-aminoacrylate, stearyl methacrylate, dimethyl aminoethyl methacrylate, diethyl aminoethyl methacrylate, and the like.

Listed as vinyl ester based monomers are vinyl acetate, vinyl propionate, vinyl benzoate, and the like.

Listed as vinyl ether based monomers are vinyl methyl ether, vinyl ethyl ether, vinyl isobutyl ether, vinyl phenyl ether, and the like.

Listed as monoolefin based monomers are ethylene, propylene, isobutylene, 1-butene, 1-pentene, 4-methyl-1-pentene, and the like. Listed as diolefin based monomers are butadiene, isoprene, chloroprene, and the like.

Listed as halogenated olefin based monomers are vinyl chloride, vinylidene chloride, vinyl bromide, and the like.

(2) Crosslinking Monomers

In order to improve the desired properties of toner, added as crosslinking monomers may be radical polymerizable crosslinking monomers. Listed as radical polymerizable agents are those having at least two unsaturated bonds such as divinylbenzene, divinylnaphthalene, divinyl ether, diethylene glycol methacrylate, ethylene glycol dimethacrylate, polyethylene glycol dimethacrylate, phthalic acid diallyl, and the like.

(3) Monomer Having an Acidic Polar Group

As the monomer having an acidic polar group, (a) an α,β-ethylenically unsaturated compound containing a carboxylic acid group (-COOH) and (b) an α,β-ethylenically unsaturated compound containing a sulfonic acid group (—$SO_3H$) can be cited.

Examples of said α,β-ethylenically unsaturated compound containing the carboxylic acid group (—COOH) of (a) include acrylic acid, methacrylic acid, fumaric acid, maleic acid, itaconic acid, cinnamic acid, maleic acid monobutyl ester, maleic acid mono-octyl ester and their sodium salts, zinc salts, etc.

Examples of said α,β-ethylenically unsaturated compound containing the sulfonic acid group (—$SO_3H$) of (b) include sulfonated styrene and its Na salt, allylsulfo succinic acid, allylsulfo succinic acid octyl ester and their sodium salts.

(4) Monomer Having a Basic Polar Group

As the monomer having a basic polar group, can be cited (i) (meth)acrylic acid ester obtained by reacting (meth) acrylic acid with an aliphatic alcohol, which has 1 to 12 carbon atoms, preferably 2 to 8 carbon atoms, specifically preferably 2 carbon atoms, and which also has an amino group or a quaternary ammonium group, (ii) (meth)acrylic acid amide or (meth)acrylic acid amide having mono-alkyl group or di-alkyl group, having 1 to 18 carbon atoms, substituted on its N atom, (iii) vinyl compound substituted with a heterocyclic group having at least a nitrogen atom in said heterocyclic group, (iv) N,N-di-allyl-alkylamine or its quaternary salt. Of these, (meth)acrylic acid ester obtained by reacting (meth)acrylic acid with the aliphatic alcohol having the amino group or the quaternary ammonium group is preferred.

Examples of (meth)acrylic acid ester obtained by reacting (meth)acrylic acid with the aliphatic alcohol having the amino group or the quaternary ammonium group of (i) include dimethylaminoethylacrylate, dimethylaminoethylmethacrylate, diethylaminoethylacrylate, diethylaminoethylmethacrylate, quaternary ammonium salts of the above mentioned four compounds, 3-dimethylaminophenylacrylate and 2-hydroxy-3-methacryloxypropyl trimethylammonium salt, etc.

Examples of (meth)acrylic acid amide or (meth)acrylic acid amide having mono-alkyl group or di-alkyl group substituted on its N atom of (ii) include acrylamide, N-butylacrylamide, N,N-dibutylacrylamide, piperidylacrylamide, methacrylamide, N-butylmethacrlamide, N,N-dimethylacrylamide, N-octadecylacrylamide, etc.

Examples of vinyl compound substituted with a heterocyclic group having at least a nitrogen atom in said heterocyclic group of (iii) include vinylpyridine, vinylpyrrolidone, vinyl-N-methylpyridinium chloride, vinyl-N-ethylpyridinium chloride, etc.

Examples of N,N-di-allyl-alkylamine or its quaternary salt of (iv) include N,N-di-allyl-methylammonium chloride, N,N-di-allyl-ethylammonium chloride, etc.

(Polymerization Initiators)

Radical polymerization initiators may be suitably employed in the present invention, as long as they are water-soluble. For example, listed are persulfate salts (potassium persulfate, ammonium persulfate, and the like), azo based compounds (4,4'-azobis-4-cyanovaleric acid and salts thereof, 2,2'-azobis(2-amidinopropane) salts, and the like), peroxides, and the like.

Further, if desired, it is possible to employ said radical polymerization initiators as redox based initiators by combining them with reducing agents. By employing said redox based initiators, it is possible to increase polymerization activity and decrease polymerization temperature so that a decrease in polymerization time is expected.

It is possible to select any polymerization temperature, as long as it is higher than the lowest radical formation temperature of said polymerization initiator. For example, the temperature range of 50 to 80° C. is employed. However, by employing a combination of polymerization initiators such as hydrogen peroxide-reducing agent (ascorbic acid and the like), which is capable of initiating the polymerization at room temperature, it is possible to carry out polymerization at room temperature or higher.

(Chain Transfer Agents)

For the purpose of regulating the molecular weight of resin particles, it is possible to employ commonly used chain transfer agents.

The chain transfer agents, for example, employed are mercaptans such as octylmercaptan, dodecylmercaptan, tert-dodecylmercaptan, and the like. The compound having mercaptan are preferably employed to give advantageous toner having such characteristics as reduced smell at the time of thermal fixing, sharp molecular weight distribution, good preservavability, fixing strength, anti-off-set and so on. The actual compounds preferably employed include ethyl thioglycolate, propyl thioglycolate, butyl thioglycolate, t-butyl thioglycolate, ethylhexyl thioglycolate, octyl thioglycolate, decyl thioglycolate, dodecyl thioglycolate, an ethyleneglycol compound having mercapt group, a neopentyl glycol compound having mercapt group, and a pentaerythritol compound having mercapt group. Among them n-octyl-3-mercaptopropionic acid ester is preferable in view of minimizing smell at the time of thermal fixing.

(Surface Active Agents)

In order to perform polymerization employing the aforementioned radical polymerizable monomers, it is required to conduct oil droplet dispersion in a water based medium employing surface active agents. Surface active agents, which are employed for said dispersion, are not particularly limited, and it is possible to cite ionic surface active agents described below as suitable ones.

Listed as ionic surface active agents are sulfonic acid salts (sodium dodecylbenzenesulfonate, sodium aryl alkyl polyethersulfonate, sodium 3,3-disulfondiphenylurea-4,4-diazo-bis-amino-8-naphthol-6-sulfonate, sodium ortho-caroxybenzene-azo-dimethylaniline-2,2,5,5-tetramethyltriphenylmethane-4,4-diazi-bis-β-naphthol-6-sulfonate, and the like), sulfuric acid ester salts (sodium dodecylsulfonate, sodium tetradecylsulfonate, sodium pentadecylsulfonate, sodium octylsulfonate, and the like), fatty acid salts (sodium oleate, sodium laureate, sodium caprate, sodium caprylate, sodium caproate, potassium stearate, calcium oleate, and the like).

In the present invention, surface active agents represented by General Formulas (1) and (2) are most preferably employed.

$R^1(OR^2)_nOSO_4M$ General Formula (1)

$R^1(OR^2)_nSO_3M$ General Formula (2)

In General Formulas (1) and (2), $R^1$ represents an alkyl group having from 6 to 22 carbon atoms or an arylalkyl group. $R^1$ is preferably an alkyl group having from 8 to 20 carbon atoms or an arylalkyl group and is more preferably an alkyl group having from 9 to 16 carbon atoms or an arylalkyl group.

Listed as alkyl group having from 6 to 22 carbon atoms represented by $R^1$ are, for example, an n-hexyl group, an n-heptyl group, an n-octyl group, an n-decyl group, an n-undecyl group, a hexadecyl group, a cyclopropyl group, a cyclopentyl group, and a cyclohexyl group. Listed as arylalkyl groups represented by $R^1$ are a benzyl group, a diphenylmethyl group, a cinnamyl group, a styryl group, a trityl group, and a phenethyl group.

In General Formulas (1) and (2), $R^2$ represents an alkylene group having from 2 to 6 carbon atoms. $R^2$ is preferably an alkylene group having 2 or 3 carbon atoms. Listed as alkylene groups having from 2 to 6 carbon atoms represented $R^2$ are an ethylene group, a trimethylene group, a tetramethylene group, a propylene group, and an ethylethylene group.

In General Formulas (1) and (2), n represents an integer of 1 to 11; and n is preferably from 2 to 10, is more preferably from 2 to 5, and is most preferably 2 or 3.

In General Formulas (1) and (2), listed as univalent metal elements represented by M are sodium, potassium, and lithium. Of these, sodium is preferably employed.

Specific examples of surface active agents represented by General Formulas (1) and (2) are illustrated below:

Compound (101): $C_{10}H_{21}(OCH_2CH_2)_2OSO_3Na$
Compound (102): $C_{10}H_{21}(OCH_2CH_2)_3OSO_3Na$
Compound (103): $C_{10}H_{21}(OCH_2CH_2)_2OS_3Na$
Compound (104): $C_{10}H_{21}(OCH_2CH_2)_3OSO_3Na$
Compound (105): $C_8H_{17}(OCH_2CH(CH_3))2OSO_3Na$
Compound (106): $C_{18}H_{37}(OCH_2CH_2)_2OSO_3Na$ In the present invention, from the viewpoint of maintaining the electrostatic charge holding function of toner in the desired state, minimizing fogging at high temperature and high humidity, and improving transferability, as well as minimizing an increase in electrostatic charge at low temperature and low humidity, and stabilizing the development amount, the content of the surface active agents represented by the aforesaid General Formulas (1) and (2) in the electrostatic image developing toner is preferably from 1 to 1,000 ppm, is more preferably from 5 to 500 ppm, and is most preferably from 7 to 100 ppm.

In the present invention, by adjusting the amount of the surface active agents incorporated to said range, the static charge of the electrostatic image developing toner of the present invention is built up being independent of ambience, and can be uniformly and stably provided and maintained.

Further, the content of the surface active agents represented by the aforesaid General Formulas (1) and (2) is calculated employing the method described below.

One g of toner is dissolved in chloroform, and surface active agents are extracted from the chloroform layer employing 100 ml of deionized water. Further, said chloroform layer, which has been extracted, is further extracted employing 100 ml of deionized water, whereby 200 ml of extract (being a water layer) is obtained, which is diluted to 500 ml.

The resulting diluted solution is employed as a test solution which is subjected to coloration utilizing Methylene Blue based on the method specified in JIS 33636. Then, its absorbance is determined, and the content of the surface active agents in the toner is determined employing the independently prepared calibration curve.

Further, said extract is analyzed employing 1H-NMR, and the structure of the surface active agents represented by General Formulas (1) and (2) is determined.

The surface active agent is employed mainly as an emulsifier, and may be used for other purpose in the other process.

(Molecular Weight Distribution of Resin Particles and Toner)

Resins used in the toner has a peak or a shoulder within the ranges of preferably from 100,000 to 1,000,000 and from 1,000 to 50,000, and more preferably in the ranges from 100,000 to 1,000,000, from 25,000 to 150,000 and from 1,000 to 50,000 in the molecular weight distribution.

The resin particles preferably comprises "a high molecular weight resin" having a peak or a shoulder within the range of from 100,000 to 1,000,000, and "a low molecular weight resin" having a peak or a shoulder within the range of from 1,000 to 50,000, and more preferably "a middle molecular weight resin" having a peak or a shoulder within the range of from 15,000 to 100,000, in the molecular weight distribution.

Molecular weight of the resin composing toner is preferably measured by gel permeation chromatography (GPC) employing tetrahydrofuran (THF).

Added to 1 cc of THF is a measured sample in an amount of 0.5 to 5.0 mg (specifically, 1 mg), and is sufficiently dissolved at room temperature while stirring employing a magnetic stirrer and the like. Subsequently, after filtering the resulting solution employing a membrane filter having a pore size of 0.48 to 0.50 $\mu$m, the filtrate is injected in a GPC.

Measurement conditions of GPC are described below. A column is stabilized at 40° C., and THF is flowed at a rate of 1 cc per minute. Then measurement is carried out by injecting approximately 100 $\mu$l of said sample at a concentration of 1 mg/cc. It is preferable that commercially available polystyrene gel columns are combined and used. For example, it is possible to cite combinations of Shodex GPC KF-801, 802, 803, 804, 805, 806, and 807, produced by Showa Denko Co., combinations of TSKgel G1000H, G2000H, G3000H, G4000H, G5000H, G6000H, G7000H, TSK guard column, and the like. Further, as a detector, a refractive index detector (IR detector) or a UV detector is preferably employed. When the molecular weight of samples is measured, the molecular weight distribution of said sample is calculated employing a calibration curve which is prepared employing monodispersed polystyrene as standard particles. Approximately ten polystyrenes samples are preferably employed for determining said calibration curve.

(Coagulants)

The coagulants selected from metallic salts are preferably employed in the processes of salting-out, coagulation and fusion from the dispersion of resin particles prepared in t e aqueous medium. The two or three valent metal salt is preferable to monovalent metal salt because of low critical coagulation concentration (coagulation point).

Listed as metallic salts, are salts of monovalent alkali metals such as, for example, sodium, potassium, lithium, etc.; salts of divalent alkali earth metals such as, for example, calcium, magnesium, etc.; salts of divalent metals such as manganese, copper, etc.; and salts of trivalent metals such as iron, aluminum, etc.

Some specific examples of these salts are described below. Listed as specific examples of monovalent metal salts, are sodium chloride, potassium chloride, lithium chloride; while listed as divalent metal salts are calcium chloride, zinc chloride, copper sulfate, magnesium sulfate, manganese sulfate, etc., and listed as trivalent metal salts, are aluminum chloride, ferric chloride, etc. Any of these are suitably selected in accordance with the application, and the two or three valent metal salt is preferable because of low critical coagulation concentration (coagulation point).

The critical coagulation concentration is an index of the stability of dispersed materials in an aqueous dispersion, and shows the concentration at which coagulation is initiated. This critical coagulation concentration varies greatly depending on the fine polymer particles as well as dispersing agents, for example, as described in Seizo Okamura, et al, Kobunshi Kagaku (Polymer Chemistry), Vol. 17, page 601 (1960), etc., and the value can be obtained with reference to the above-mentioned publications. Further, as another method, the critical coagulation concentration may be obtained as described below. An appropriate salt is added to a particle dispersion while changing the salt concentration to measure the ζ potential of the dispersion, and in addition the critical coagulation concentration may be obtained as the salt concentration which initiates a variation in the ζ potential.

The polymer particles dispersion liquid is processed by employing metal salt so as to have concentration not less than critical coagulation concentration. In this instance the metal salt is added directly or in a form of aqueous solution optionally, which is determined according to the purpose. In case that it is added in an aqueous solution the metal salt must satisfy the critical coagulation concentration including the water as the solvent of the metal salt.

The concentration of coagulant may be not less than the critical coagulation concentration. However, the amount of the added coagulant is preferably at least 1.2 times of the critical coagulation concentration, and more preferably 1.5 times.

Further, it is possible to employ nonionic surface active agents. Specifically, it is possible to cite polyethylene oxide, polypropylene oxide, a combination of polypropylene oxide and polyethylene oxide, alkylphenol polyethylene oxide, esters of polyethylene glycol with higher fatty acids, esters of polypropylene oxide with higher fatty acids, sorbitan esters, and the like.

<Colorants>

The toner is obtained by salting out/fusing the composite resin particles and colored particles.

Listed as colorants which constitute the toner of the present invention may be inorganic pigments, organic pigments, and dyes.

Employed as said inorganic pigments may be those conventionally known in the art. Specific inorganic pigments are listed below.

Employed as black pigments are, for example, carbon black such as furnace black, channel black, acetylene black, thermal black, lamp black, and the like, and in addition, magnetic powders such as magnetite, ferrite, and the like.

If desired, these inorganic pigments may be employed individually or in combination of a plurality of these. Further, the added amount of said pigments is commonly between 2 and 20 percent by weight with respect to the polymer, and is preferably between 3 and 15 percent by weight.

Employed as said organic pigments and dyes may be those conventionally known in the art. Specific organic pigments as well as dyes are exemplified below.

The organic pigment or organic dye is also employed, examples thereof are listed.

Listed as pigments for magenta or red are C.I. Pigment Red 2, C.I. Pigment Red 3, C.I. Pigment Red 5, C.I. Pigment Red 6, C.I. Pigment Red 7, C.I. Pigment Red 15, C.I. Pigment Red 16, C.I. Pigment Red 48:1, C.I. Pigment Red 53:1, C.I. Pigment Red 57:1, C.I. Pigment Red 122, C.I. Pigment Red 123, C.I. Pigment Red 139, C.I. Pigment Red 144, C.I. Pigment Red 149, C.I. Pigment Red 166, C.I. Pigment Red 177, C.I. Pigment Red 178, C.I. Pigment Red 222, and the like.

Listed as pigments for orange or yellow are C.I. Pigment Orange 31, C.I. Pigment Orange 43, C.I. Pigment Yellow 12, C.I. Pigment Yellow 13, C.I. Pigment Yellow 14, C.I. Pigment yellow 15, C.I. Pigment Yellow 17, C.I. Pigment Yellow 93, C.I. Pigment Yellow 94, C.I. Pigment Yellow 138, C.I. Pigment Yellow 155, C.I. Pigment Yellow 156, C.I. Pigment yellow 180, C.I. Pigment Yellow 185, Pigment Yellow 155, Pigment Yellow 186, and the like.

Listed as pigments for green or cyan are C.I. Pigment Blue 15, C.I. Pigment Blue 15:2, C.I. Pigment Blue 15:3, C.I. Pigment Blue 16, C.I. Pigment Blue 60, C.I. Pigment Green 7, and the like.

Employed as dyes may be C.I. Solvent Red 1, 59, 52, 58, 63, 111, 122; C.I. Solvent Yellow 19, 44, 77, 79, 81, 82, 93, 98, 103, 104, 112, 162; C.I. Solvent Blue 25, 36, 60, 70, 93, and 95; and the like. Further these may be employed in combination.

If desired, these organic pigments, as well as dyes, may be employed individually or in combination of selected ones. Further, the added amount of pigments is commonly between 2 and 20 percent by weight, and is preferably between 3 and 15 percent by weight.

Said colorants may also be employed while subjected to surface modification. As said surface modifying agents may be those conventionally known in the art, and specifically, preferably employed may be silane coupling agents, titanium coupling agents, aluminum coupling agents, and the like.

Examples of the silane coupling agent include alkoxysilane such as methyltrimethoxysilane, phenyltrimethoxysilane, methylphenyldimethoxysilane and diphenyldimethoxysilane; siloxane such as hexamethyldisiloxane, γ-chloropropyltrimethoxysilane, vinyltrichlorosilane, vinyltrimethoxysilane, vinyltriethoxysilane, γ-methacryloxypropyltrimethoxysilane, γ-glycidoxypropyltrimethoxysilane, γ-mercaptopropyltrimethoxysilane, γ-aminopropyltriethoxysilane, and γ-ureidopropyltriethoxysilane.

Examples of the titanium coupling agent include those marketed with brand "Plainact" TTS, 9S, 38S, 41B, 46B, 55, 138S, 238S etc., by Ajinomoto Corporation, A-1, B-1, TOT, TST, TAA, TAT, TLA, TOG, TBSTA, A-10, TBT, B-2, B-4, B-7, B-10, TBSTA-400, TTS, TOA-30, TSDMA, TTAB, TTOP etc., marketed by Nihon Soda Co., Ltd.

Examples of the aluminum coupling agent include "Plainact AL-M".

These surface modifiers is added preferably in amount of 0.01 to 20% by weight, and more preferably 0.5 to 5% by weight with reference to the colorant.

Surface of the colorant may be modified in such way that the surface modifier is added to the dispersion of colorant, then the dispersion is heated to conduct reaction.

Colorant having subjected to the surface modification is separated by filtration and dried after repeating rinsing and filtering with the same solvent.

(Crystalline Materials)

Toner employed in the invention is preferably prepared by fusing resin particles containing a crystalline material and colored particles in water based medium and then digesting the obtained particles whereby the crystalline material and the colorant are dispersed in resin matrix adequately to form a domain-matrix structure. The digestion is a process subjecting the fused particles to continuing agitation at a temperature of melting point of the crystalline material plus minus 20 centigrade.

Preferable examples of the crystalline material having releasing property include low molecular weight polypropylene having average molecular weight of 1,500 to 9,000 and low molecular weight polyethylene, and a particularly preferable example is an ester compounds represented by General Formula (1), described below.

$$R^1—(OCO—R^2)_n \quad (1):$$

wherein n represents an integer of 1 to 4, and preferably 2 to 4, more preferably 3 or 4, and in particular preferably 4, $R^1$ and $R^2$ each represent a hydrocarbon group which may have a substituent respectively. $R^1$ has from 1 to 40 carbon atoms, and preferably 1 to 20, more preferably 2 to 5. $R^2$ has from 1 to 40 carbon atoms, and preferably 16 to 30, more preferably 18 to 26.

The representative examples are listed.

1) $CH_3—(CH_2)_{12}—COO—(CH_2)_{17}—CH_3$

2) $CH_3—(CH_2)_{18}—COO—(CH_2)_{17}—CH_3$

3) $CH_3—(CH_2)_{20}—COO—(CH_2)_{21}—CH_3$

4) $CH_3—(CH_2)_{14}—COO—(CH_2)_{19}—CH_3$

5) $CH_3—(CH_2)_{20}—COO—(CH_2)_6—O—CO—(CH_2)_{20}—CH_3$

6) $CH_3—(CH_2)_{20}—COO—(CH_2)_2—CH(CH_3)—CH_2—O—CO—(CH_2)_{20}—CH_3$

7) $CH_3—(CH_2)_{22}—COO—(CH_2)_2—CH(CH_3)—CH_2—O—CO—(CH_2)_{22}—CH_3$

8) $CH_3—(CH_2)_{22}—COO—CH_2—C(CH_3)_2—CH_2—O—CO—(CH_2)_{22}—CH_3$

9) $CH_3—(CH_2)_{26}—COO—CH_2—C(CH_3)_2—CH_2—O—CO—(CH_2)_{26}—CH_3$

10) $CH_2(O—CO—(CH_2)_{26}—CH_3)—CH(O—CO—(CH_2)_{26}—CH_3)—CH_2—O—CO—(CH_2)_{26}—CH_3$

11) $CH_2(O—CO—(CH_2)_{22}—CH_3)—CH(O—CO—(CH_2)_{22}—CH_3)—CH_2—O—CO—(CH_2)_{22}—CH_3$

-continued

12) $CH_2—OH—CH(O—CO—(CH_2)_{26}—CH_3)—CH_2—O—CO—(CH_2)_{26}—CH_3$

13) $CH_2—OH—CH(O—CO—(CH_2)_{22}—CH_3)—CH_2—O—CO—(CH_2)_{22}—CH_3$

14) $CH_2—OH—CH(OH)—CH_2—O—CO—(CH_2)_{26}—CH_3$

15) $CH_2—OH—CH(OH)—CH_2—O—CO—(CH_2)_{22}—CH_3$

16) $CH_3—(CH_2)_{26}—COO—CH_2—C(CH_3)(CH_2—O—CO—(CH_2)_{26}—CH_3)_2$

17) $CH_3—(CH_2)_{20}—COO—CH_2—C(CH_2CH_3)(CH_2—O—CO—(CH_2)_{20}—CH_3)_2$

18) $CH_3—(CH_2)_{26}—COO—CH_2—C(CH_2—O—CO—(CH_2)_{26}—CH_3)_3$

19) $CH_3—(CH_2)_{20}—COO—CH_2—C(CH_2—O—CO—(CH_2)_{20}—CH_3)_3$

20) $CH_3—(CH_2)_{18}—COO—CH_2—C(CH_2—O—CO—(CH_2)_{18}—CH_3)_3$

21) $CH_3—(CH_2)_{16}—COO—CH_2—C(CH_2—O—CO—(CH_2)_{16}—CH_3)_3$

22) $CH_3—(CH_2)_{20}—COO—CH_2—C(CH_2—O—CO—CH_3)_3$

As a compound constituting crystalline polyester obtained by reaction of aliphatic diol with an aliphatic dicarboxylic acid (acid anhydride and acid chloride are included) is preferable.

Example of the diol which is used in order to obtain crystalline polyester includes ethylene glycol, diethylene glycol, triethylene glycol, 1,2-propylene glycol, 1,3-propylene glycol, 1,4-butane diol, 1,4-butene diol, neopentyl glycol, 1,5-pentane glycol, 1,6-hexane glycol, 1,4-cyclohexane diol, 1,4-cyclohexane di methanol, dipropylene glycol, polyethylene glycol, polypropylene glycol, poly tetramethylene glycol, bisphenol A, bisphenol Z, and hydrogenated bisphenol A.

As the dicarboxylic acid which is use in order to obtain crystalline polyester and crystalline polyamide, oxalic acid, malonic acid, succinic acid, glutaric acid, adipic acid, pimelic acid, suberic acid, azelaic acid, sebacic acid, maleic acid, fumaric acid, citraconic acid, itaconic acid, glutaconate, n-dodecyl succinic acid, n-dodecenyl succinic acid, iso dodecyl succinic acid, iso dodecenyl succinic acid, n-octyl succinic acid, n-oxotenyl succinic acid, and these acid anhydride or an acid chloride can be mentioned.

In particular as a preferable crystalline polyester compound, polyester obtained by reacting cyclohexane diol or 1,4-cyclohexanedimethanol with adipic acid, polyester obtained by reacting 1,6-hexanediol or 1,4-cyclohexane dimethanol with sebacic acid, polyester obtained by reacting ethylene glycol and succinic acid, polyester obtained by reacting ethylene glycol and sebacic acid, polyester obtained by reacting 1,4-butanediol and succinic acid can be mentioned. Among these, the polyester obtained by reacting cyclohexane diol, 1,4-cyclohexanedimethanol and adipic acid is particularly preferable.

As a containing ratio of the compound in the toner, it is preferable that crystalline polyester is from 1 to 30 percent by weight, and more preferably from 2 to 20 percent by weight, and in particular from 3 to 15 percent by weight of toner weight as a whole.

<Developers>

The toner of the present invention may be employed in either a single-component developer or a two-component developer.

Listed as single-component developers are a non-magnetic single-component developer, and a magnetic single-component developer in which magnetic particles having a diameter of 0.1 to 0.5 $\mu$m are incorporated into a toner. Said toner may be employed in both developers.

Further, said toner is blended with a carrier and employed as a two-component developer. In this case, employed as magnetic particles of the carrier may be conventional materials known in the art, such as metals such as iron, ferrite, magnetite, and the like, alloys of said metals with aluminum, lead and the like. Specifically, ferrite particles are preferred. The volume average particle diameter of said magnetic particles is preferably 15 to 100 $\mu$m, and is more preferably 25 to 80 $\mu$m.

The volume average particle diameter of said carrier can be generally determined employing a laser diffraction type particle diameter distribution measurement apparatus "Helos", produced by Sympatec Co., which is provided with a wet type homogenizer.

The preferred carrier is one in which magnetic particles are further coated with resins, or a so-called resin dispersion type carrier in which magnetic particles are dispersed into resins. Resin compositions for coating are not particularly limited. For example, employed are olefin based resins, styrene based resins, styrene-acryl based resins, silicone based resins, ester based resins, or fluorine containing polymer based resins. Further, resins, which constitute said resin dispersion type carrier, are not particularly limited, and resins known in the art may be employed. For example, listed may be styrene-acryl based resins polyester resins, fluorine based resins, phenol resins, and the like.

The image forming apparatus employed in the image forming method using the toner of the invention is described.

Figure 3:
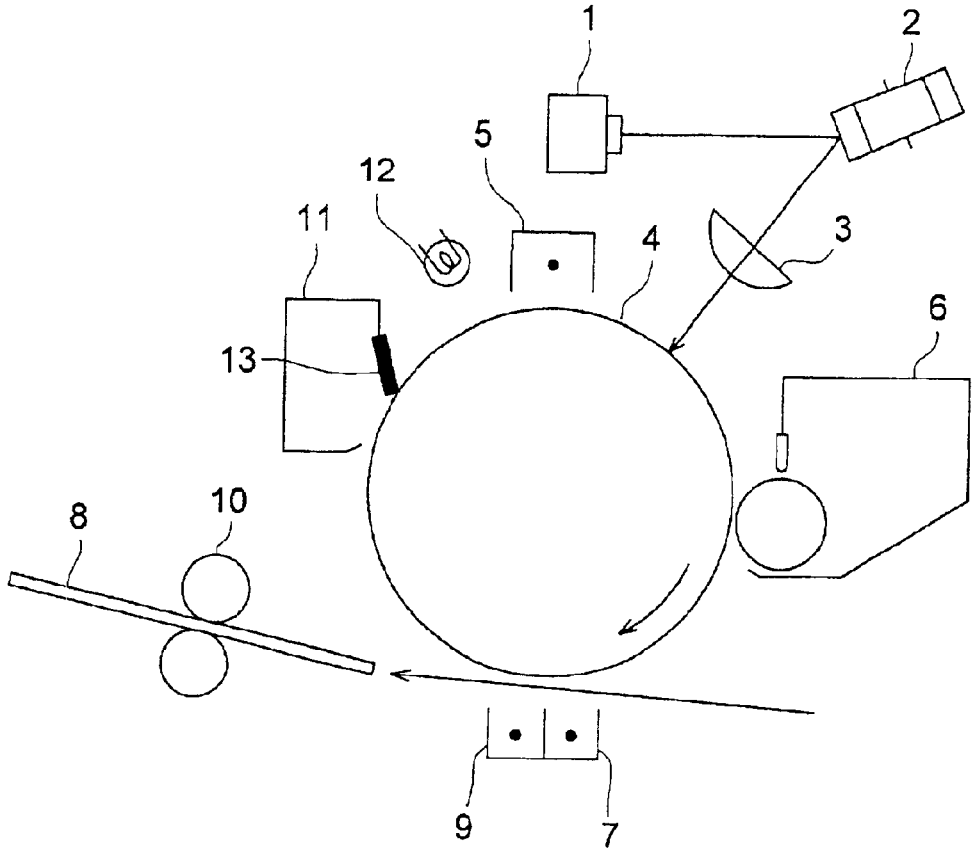
FIG. 3 a cross-sectional view showing one example of the structure of an image forming apparatus applied to the present invention.

A cross-section of a color forming apparatus is shown in FIG. 3 as an example of the color forming apparatus for describing the image forming method according to the invention. In FIG. 3, numeral 4 shows a photoreceptor drum as a latent image carrier, which is constituted by coating OPC or organic photosensitive substance, on a substrate drum. The photoreceptor drum is grounded and driven so as to be clockwise rotated as is shown in the drawing.

Light exposure is emitted from laser diode source 1 according to the image information read in by reading means, not shown in FIG. 3. The light is scanned in a direction perpendicular to the paper plain by a rotating polygon mirror 2, and is exposed to the photoreceptor to form a latent image through an fθ lens 3, which compensate distortion of image. The photoreceptor drum 4 is charged uniformly by a charger 5 previously and starts rotation synchronized with the timing of the image exposure.

The latent image on the photoreceptor is developed by developing device 6, and the developed image is transferred to synchronously driven transferee paper 8 by transfer device 7. The transferee paper 8 is separated from the photoreceptor 4 by separating device (separating pole) 9, and the transferred image on the transferee paper is carried to fixing device to be fixed.

Remaining toner particles on the photoreceptor are swept by cleaning device 11. The residual charge on the photoreceptor is cancelled through precharging exposure light 12, and the photoreceptor is again charged uniformly by charging device 5.

Methods for recycling toner are not particularly limited. For example, it is possible to cite a method in which toner recovered at a cleaning section is conveyed to a hopper for supply toner, or a development unit employing a transport conveyer or a transport screw, or is blended with a supply toner in an intermediate chamber and supplied to a development unit. As preferred methods, it is possible to list methods in which the recovered toner is directly returned to the development unit or the recovered toner is blended with the supply toner and then supplied to the development unit.

Figure 4:
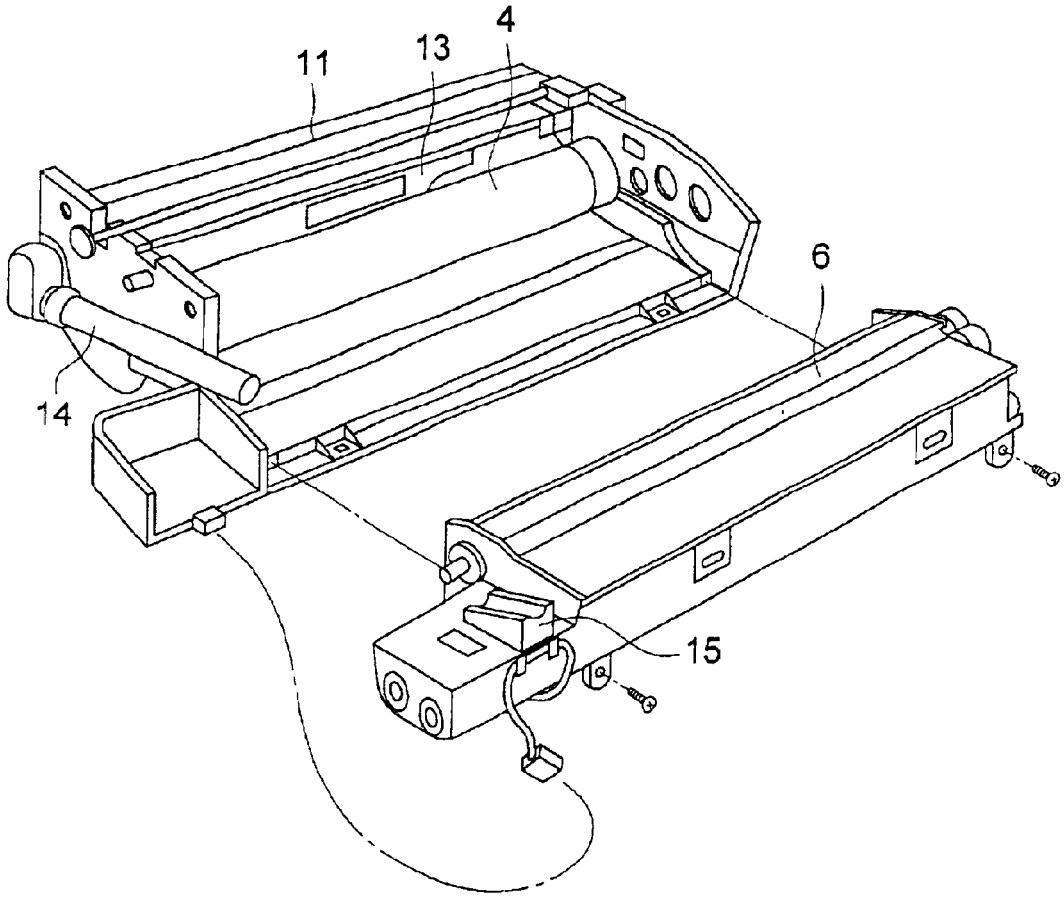
FIG. 4 is a perspective view showing the structure of a toner recycling member.

FIG. 4 is a perspective view of one example of the constitution of a toner recycling member. This method is one in which the recovered toner is returned directly to the development unit.

Non-transferred toner recovered by cleaning blade 13 is collected and fed into toner recycling pipe 14, employing a transport screw in toner cleaning unit 11; then returned to development unit 6 from inlet 15 of said recycling pipe; and again employed as developer.

FIG. 4 is also a perspective view of a detachable processing unit which is secured to the image forming apparatus of the present invention. In said FIG. 4, in order to clarify the perspective configuration, the photoreceptor unit is drawn separately from the developer unit. However, these may be integrated and detachably attached as a unit to the image forming apparatus. In this case, the photoreceptor, the development unit, the cleaning unit and the recycling member are integrated and comprised as the processing cartridge.

Further, said image forming apparatus may be structured so that a processing cartridge can be installed which comprises at least one of a photoreceptor drum, a charging unit, a development unit, a cleaning unit, or a recycling member.

Representative transfer paper includes plain paper. However, it is not particularly limited as long as unfixed images after development can be transferred, and includes a PET base for OHP.

Further, cleaning blade 13 is comprised of an elastic rubber body having a thickness of 1 to 30 mm. As such material, urethane rubber is most frequently employed. Since cleaning blade 13 is employed by being brought into pressure contact with the photoreceptor, it easily transmits heat. As a result, it is preferable to be withdrawn from the photoreceptor by providing a releasing mechanism while the image forming operation is not being performed.

Figure 5:
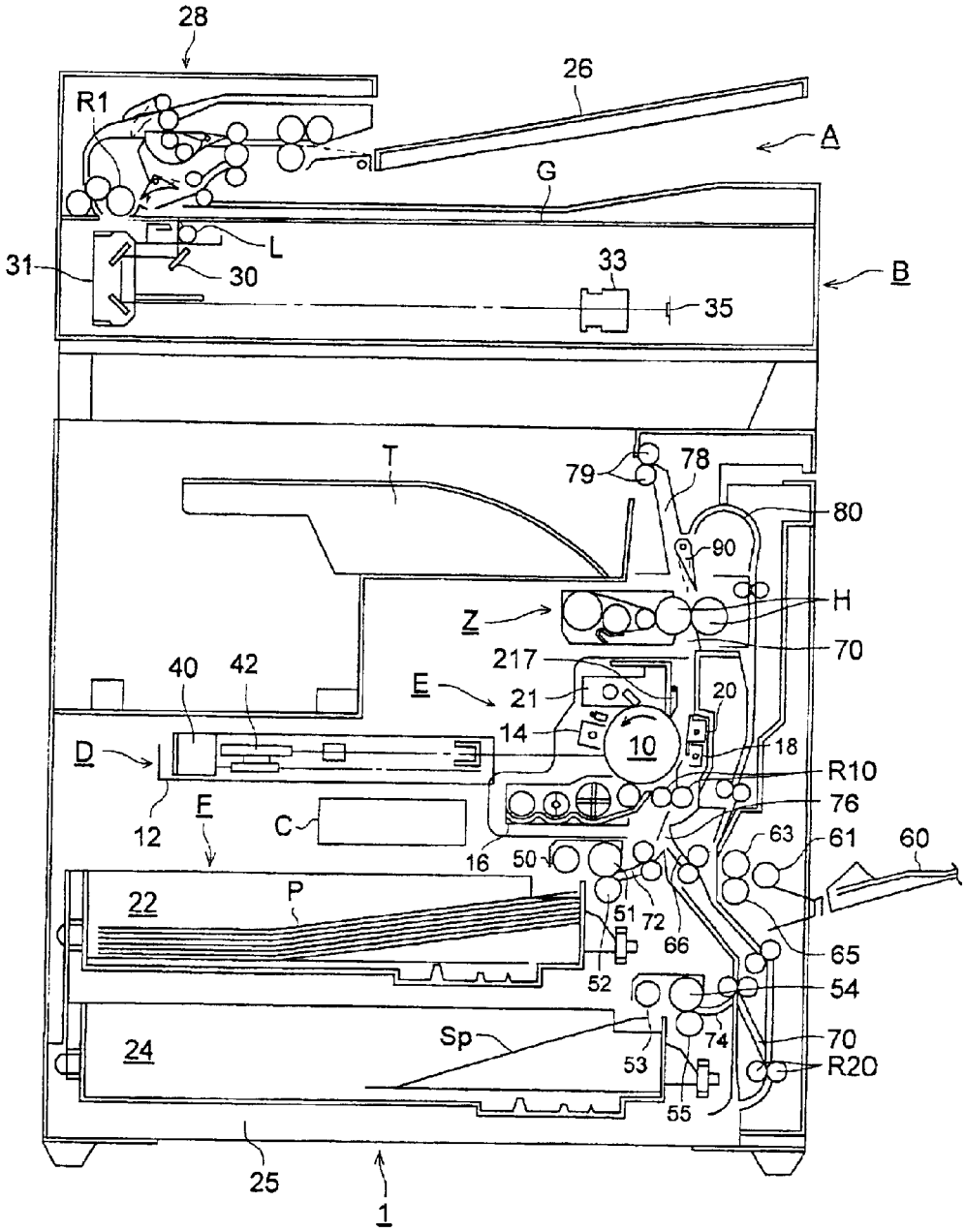
FIG. 5 is a schematic view showing a digital image forming apparatus applied to the present invention.

It is possible to apply the present invention to an apparatus utilizing the electrophotographic method, especially an apparatus in which electrostatic images are formed on the photoreceptor, utilizing a modulation beam which has been modulated based on digital image data from a computer. FIG. 5 is a schematic view showing a digital image forming apparatus which is applied to the toner of the present invention.

In recent years, in the electrophotographic field wherein electrostatic latent images are formed on a photoreceptor and the resultant latent images are developed to prepare visible images, increasingly carried out has been research and development of the image forming method utilizing a digital system which makes it possible to easily carry out improvement in image quality, transformation, and edition, and to form high quality images.

As computers which are employed in said image forming method and apparatus thereof, or an optical scanning system which carries out light modulation based on digital image signals from copying original documents, included are a unit in which an acoustic optical modulator is provided via an optical laser system and light modulation is carried out employing said acoustic optical modulator, as well as a unit in which a semiconductor laser is employed and laser intensity is subjected to direct modulation. Spot exposure is carried out onto a uniformly charged photoreceptor from said optical scanning system whereby dot images are formed.

A beam irradiated from said optical scanning system results in a circular or elliptical luminance distribution near the normal distribution having a wide range at both sides. For example, a laser beam in either the primary direction or the secondary direction, or in both directions on the photoreceptor, generally results in extremely narrow circles or ellipses of 20 to 100 $\mu$m.

The toner of the present invention is suitably applied to the image forming method comprising a process in which an image forming support, on which a toner image is formed, is passed between a heating roller and a pressing roller, constituting a fixing unit, so as to fix said image.

Figure 6:
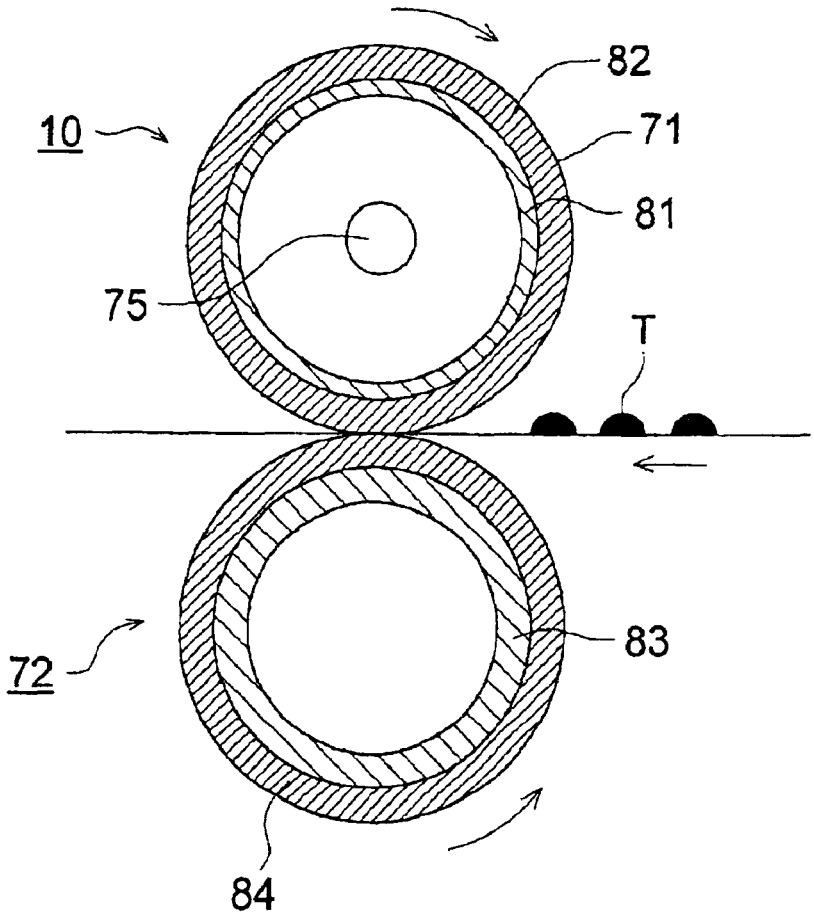
FIG. 6 is a schematic cross-sectional view showing a fixing unit applied to the present invention.

FIG. 6 is a cross-sectional view showing one example of a fixing unit used in an image forming method employing the toner of the present invention. Fixing unit 10, shown in FIG. 6, is comprised of heating roller 71, and pressing roller 72 which comes into contact with said heating roller 71. Incidentally, in FIG. 6, T is a toner image formed on a transfer paper (being the image forming support).

Said heating roller 71 is prepared by forming cover layer 82 comprised of fluorine resins or an elastic body on the surface of metal pipe 81 and includes heating member 75 comprised of a linear heater in its interior.

Metal pipe 81 is comprised of metal, and its interior diameter is from 10 to 70 mm. Metals which comprise metal pipe 81 are not particularly limited, and may include, for example, iron, aluminum, and copper, and alloys thereof.

The wall thickness of said metal pipe 81 is from 0.1 to 15 mm, and is determined taking into account the balance between the energy saving demand (a decrease in the wall thickness) and strength (being dependent on composition of the materials). For example, when the strength exhibited by a metal pipe comprised of iron with a wall thickness of 0.57 mm is intended to obtain employing a metal pipe comprised of aluminum, it is necessary to increase its wall thickness to 0.8 mm.

Exemplified as fluorine resins constituting covering layer 82 may be PTFE (polytetrafluoroethylene), PFA (tertafluoroethylene-perfluoroalkyl vinyl ether copolymers), and the like.

The thickness of covering layer is usually 10 to 500 $\mu$m, and is preferably 20 to 400 $\mu$m.

The elastic material forming a covering layer 12 includes silicone rubber or silicone sponge, which has good heat resistance, such as LTV, RTV and HTV.

An Asker C harness of the elastic material covering layer 12 is less than 80 degrees, preferably less than 80 degrees.

The thickness of the elastic material covering layer 12 is 0.1 to 30 mm, and preferably 0.1 to 20 mm.

Halogen heaters may be suitably employed as heating member 75.

Pressure roller 72 comprises cylinder 83 having on its surface covering layer 84 comprised of elastic materials. Elastic materials constituting covering layer are not particularly limited, and may include various types of soft rubber such as urethane rubber, silicone rubber, and the like, and also foamed rubber. Silicone rubber as well as silicone sponge rubber is preferably employed, which is exemplified as those constituting covering layer.

The Asker C hardness of elastic materials, constituting covering layer 84, is commonly less than 80 degrees, is preferably less than 70 degrees, and is more preferably less than 60 degrees.

Further, the thickness of covering layer 22 is commonly 0.1 to 30 mm, and is preferably 0.1 to 20 mm.

Materials constituting cylinder 21 include metals such as aluminum, iron, copper, and the like, and alloys thereof.

The contact load (total load) of heating roller 10 applied to pressure roller 72 is usually 40 to 350 N, is preferably 50 to 300 N, and is more preferably 50 to 250 N. Said load is set taking into the strength (the wall thickness of cylinder 81) of heating roller 10. For example, when a heating roller comprised of an iron cylinder having a wall thickness of 0.3 mm is employed, the applied load is preferably not more than 250 N.

Further, from the viewpoint of offsetting resistance as well as fixability, nip width is preferably 4 to 10 mm, and the surface pressure of said nip is preferably $0.6\times10^5$ to $1.5\times10^5$ Pa.

When the fixing unit shown in FIG. 6 is employed, an example of fixing conditions are as follows: fixing temperature (surface temperature of heating roller 10) is 150 to 210° C., and fixing linear speed is 80 to 640 mm/second.

EXAMPLES

The present inventing will now be detailed with reference to examples. The term "part (s)" denotes part (s) by weight.

Preparation of Latex

Latex 1HML (1) Preparation of Core Particle (a First Stage Polymerization)

Placed into a 5,000 ml separable flask fitted with a stirring unit, a temperature sensor, a cooling pipe, and a nitrogen gas inlet was a surface active agent solution (water based medium) prepared by dissolving 7.08 g of an anionic surface active agent (101) in 3,010 g of deionized water, and the interior temperature was raised to 80° C. under a nitrogen gas flow while stirring at 230 rpm.

(101) $C_{10}H_{21}(OCH_2CH_2)_2OS_4Na$

Subsequently, a solution prepared by dissolving 9.2 g of a polymerization initiator (potassium persulfate, KPS) in 200 g of deionized water was added to the surface active agent solution and it was heated at 75° C., a monomer mixture solution consisting of 70.1 g of styrene, 19.9 g of n-butyl acrylate, and 10.9 g of methacrylic acid was added dropwise over 1 hour. The mixture underwent polymerization by stirring for 2 hours at 75° C. (a first stage polymerization). Thus latex (a dispersion comprised of higher molecular weight resin particles) was obtained. The resulting latex was designated as Latex (1H). The Latex (1H) has a peak molecular weight at 138,000.

(2) Forming an Inter Layer

A monomer solution was prepared in such way that 98.0 g of Exemplified Compound 19) was added to monomer mixture solution consisting of 105.6 g of styrene, 30.0 g of n-butyl acrylate, 6.2 g of methacrylic acid, 5.6 g of n-octyl-3-mercaptopropionic acid ester and the mixture was heated to 90° C. to dissolve the monomers in a flask equipped with a stirrer.

Surfactant solution containing 1.6 g of anionic surfactant (101) dissolved in 2,700 ml of deionized water was heated to 98° C. To the surfactant solution 28 g (converted in solid content) the latex 1H, dispersion of core particles, was added, then the monomer solution containing the Exemplified Compound 19) was mixed and dispersed by means of a mechanical dispersion machine, "CLEARMIX" (produced by M Technique Ltd.) equipped with circulating pass for 8 hours, and a dispersion (emulsion) containing dispersion particles (oil droplet) was prepared.

Subsequently, initiator solution containing 5.1 g of polymerization initiator (KPS) dissolved in 240 ml of deionized water, and 750 ml of deionized water were added to the dispersion (emulsion). Polymerization was conducted by stirring with heating at 98° C. for 12 hours, as the result, latex (dispersion of composite resin particles which are composed of resin particles having higher molecular weight polymer resin covered with an intermediate molecular weight polymer) was obtained (a second stage polymerization). The resulting latex was designated as Latex (1HM).

Particles having diameter of 400 to 2,000 nm composed of mainly Exemplified Compound 19), which is not incorporated in the latex particles, are observed in the dried the Latex 1HM by scanning electron microscope.

(3) Forming Outer Layer (Third Stage Polymerization)

Polymerization initiator solution containing 7.4 g of polymerization initiator KPS dissolved in 200 ml deionized water was added to the latex 1HM, then monomer mixture solution consisting of 300 g of styrene, 95 g of n-butylacrylate, 15.3 g of methacrylic acid, and 10.4 g of n-octyl-3-mercaptoprpionic ester was added dropwise over 1 hour at temperature of 80° C. The mixture underwent polymerization by stirring with heating for 2 hours (a third stage polymerization), it was cooled to 28° C. Thus Latex 1HML composed of core composed of higher molecular weight polymer resin, an inter layer composed of an intermediate molecular weight polymer resin and an outer layer composed of lower molecular weight polymer resin in which inter layer the Exemplified Compound 19) was incorporated was obtained.

The polymers composed of composite resin particles composing the latex 1HML have peaks at molecular weight of 138,000, 80,000 and 13,000, and weight average particular size of the composite resin particles was 122 nm. Latex 2HML Latex 2HML was prepared in the same manner as the preparation of 1HML except that 7.08 g of anionic surface active agent, sodium dodecylsulfonate (SDS) was employed in place of the surface active agent (101). Latex 2HML is a dispersion of composite resin particle having core part composed of high molecular weight resin, inter layer part composed of middle molecular weight resin and outer layer part composed of low molecular weight resin.

The polymers composed of composite resin particles composing the latex 2HML have peaks at molecular weight of 138,000, 80,000 and 12,000, and weight average particular size of the composite resin particles was 110 nm.

(Preparation Black Colored Particles 1Bk to 5Bk and 12Bk)

Added to 1600 ml of deionized water were 59.0 g of polyoxyethylene lauryl ether sodium sulfite (the numbers of adducts of ethyleneoxide 3), which were stirred and dissolved. While stirring the resulting solution, 420.0 g of carbon black, "Regal 330" (produced by Cabot Corp.), were gradually added, and subsequently dispersed employing a stirring unit, "Clearmix" (produced by M Technique Ltd.). Black Colorant Dispersion Bk was obtained. Weight average weight particle diameter of the Black Colorant in the dispersion was 89 nm, measured by employing an electrophoresis light scattering photometer "ELS-800" (produced by Ohtsuka Denshi Co.).

Placed into a four-necked flask fitted with a temperature sensor, a cooling pipe, a nitrogen gas inlet unit, and a stirring unit were 420.7 g (converted in solid content) of Latex (1HML), 900 g of deionized water, and 166 g of Black Colorant Dispersion Bk, and the resulting mixture was stirred. After adjusting the interior temperature to 30° C., 5N aqueous sodium hydroxide solution was added to the resulting solution, and the pH was adjusted to within the range from 8 to 10.0.

Subsequently, an aqueous solution prepared by dissolving 12.1 g of magnesium chloride tetrahydrate in 1,000 ml of deionized water was added at 30° C. over 10 minutes. After setting the resulting mixture aside for 3 minutes, it was heated so that the temperature was increased to 90° C. within the range from 6 to 60 minutes. While maintaining the resulting state, the diameter of coalesced particles was measured employing a "Coulter Counter TA-II". When the volume average particle diameter reached 4 to 7 $\mu$m, the growth of particles was terminated by the addition of an aqueous solution prepared by dissolving 80.4 g of sodium chloride in 1,000 ml of deionized water, and further fusion was continually carried out at a liquid media temperature of 85 to 98° C. for 2 to 12 hours, while being heated and stirred (digestion process).

Thereafter, the temperature was decreased to 30° C. Subsequently, the pH was adjusted to 2.0, and stirring was terminated. The resulting coalesced particles were collected through filtration, and washed with deionized water repeatedly. Washed particles were then dried by air at 40° C., and the colored particles were obtained.

The colored particles 1–16 and comparative colored particles 1–8 having characteristics of dispersion state, shape, particle size distribution and domain-matrix structure respectively shown in Tables 1 to 3, were obtained by controlling the dispersion property, shape and variation coefficient of shape of crystalline material and colorant, by varying pH during coagulation process, temperature, time and agitation strength of digestion process, and further by classification in liquid.

TABLE 1

| Example No. | Average FERE vertical diameter | Variation Coefficient of FERE vertical diameter | The number of the islands in a toner particle | Percentage of toner particles having 1–20 islands in a toner particle | Average shape coefficient | Variation of shape coefficient | Percentage of toner particles having shape coefficient of 100–120 | Percentage of toner particles having shape coefficient not less than 240 |
|---|---|---|---|---|---|---|---|---|
| 1 | 510 | 24 | 12 | 100 | 184 | 25.1 | 3.2 | 4.8 |
| 2 | 565 | 31 | 11 | 100 | 165 | 24.5 | 2.8 | 6.8 |
| 3 | 542 | 23 | 18 | 100 | 173 | 27.1 | 2.9 | 4.8 |
| 4 | 622 | 34 | 16 | 100 | 180 | 29.5 | 4.2 | 6.7 |
| 5 | 486 | 22 | 12 | 99.9 | 177 | 27.4 | 3.8 | 5.6 |
| 6 | 526 | 26 | 8 | 99.9 | 164 | 22.5 | 2.7 | 4.2 |
| 7 | 694 | 30 | 10 | 99.8 | 159 | 26.9 | 3.5 | 4.8 |
| 8 | 422 | 32 | 9 | 99.7 | 173 | 21.8 | 4.1 | 6.3 |
| 9 | 594 | 29 | 9 | 99.8 | 177 | 24.5 | 3.5 | 7.6 |
| 10 | 563 | 26 | 11 | 99.6 | 172 | 22.1 | 2.7 | 5.7 |
| 11 | 484 | 31 | 10 | 99.6 | 180 | 26.2 | 4.4 | 5.5 |
| 12 | 552 | 32 | 13 | 99.7 | 189 | 27.5 | 3.6 | 5.9 |
| 13 | 622 | 33 | 8 | 99.8 | 212 | 34.4 | 7.8 | 14.5 |
| 14 | 726 | 29 | 14 | 99.6 | 135 | 37.0 | 21.0 | 12.0 |
| 15 | 460 | 28 | 22 | 99.1 | 148 | 22.1 | 4.8 | 1.4 |
| 16 | 180 | 42 | 18 | 99.4 | 165 | 24.6 | 3.4 | 2.6 |
| Comp. 1 | 186 | 44 | 4 | 97.8 | 135 | 37.8 | 32.1 | 7.1 |
| Comp. 2 | 970 | 46 | 24 | 98.8 | 230 | 45.4 | 7.2 | 43.2 |
| Comp. 3 | 171 | 43 | 26 | 97.5 | 132 | 36.8 | 15.0 | 9.9 |
| Comp. 4 | 167 | 42 | 23 | 98.8 | 248 | 44.3 | 2.1 | 47.8 |
| Comp. 5 | 191 | 43 | 5 | 98.6 | 270 | 38.0 | 4.4 | 76.9 |
| Comp. 6 | 942 | 44 | 26 | 98.4 | 135 | 37.5 | 55.3 | 2.6 |
| Comp. 7 | 980 | 41 | 4 | 98.8 | 234 | 36.8 | 6.1 | 44.8 |
| Comp. 8 | 922 | 43 | 5 | 98.1 | 127 | 37.1 | 67.5 | 1.8 |

TABLE 2

| Example No. | Average area of Voronoi polygon | Variation coefficient of area of Voronoi polygon | Percentage of toner particles having Voronoi polygon area of 1600 $nm^2$ | Average area of Voronoi polygon inside 1 $\mu m$ radius circle | Average area of Voronoi polygon outside 1 $\mu m$ radius circle | The number of the islands having of Voronoi polygon area at least 160,000 $nm^2$ contact with the external circumference |
|---|---|---|---|---|---|---|
| 1 | 84,200 | 10.5 | 7.2 | 76,700 | 98,500 | 11 |
| 2 | 76,500 | 19.5 | 3.5 | 66,500 | 79,600 | 13 |
| 3 | 66,400 | 14.1 | 6.1 | 62,500 | 68,800 | 14 |
| 4 | 96,200 | 18.2 | 7.2 | 86,400 | 99,600 | 24 |
| 5 | 77,400 | 9.9 | 14.6 | 71,500 | 79,400 | 27 |
| 6 | 46,500 | 15.6 | 12.5 | 42,600 | 48,800 | 16 |
| 7 | 86,800 | 10.6 | 17.3 | 81,200 | 87,900 | 17 |
| 8 | 76,300 | 12.8 | 14.2 | 74,800 | 77,600 | 8 |
| 9 | 116,600 | 23.9 | 18.3 | 108,000 | 119,000 | 28 |
| 10 | 27,500 | 7.7 | 3.6 | 21,200 | 35,400 | 6 |
| 11 | 96,400 | 18.1 | 2.5 | 97,600 | 92,200 | 2 |
| 12 | 439,000 | 31.2 | 32.1 | 432,000 | 458,300 | 51 |
| 13 | 66,800 | 18.6 | 7.4 | 64,500 | 69,700 | 6 |
| 14 | 44,200 | 19.5 | 4.6 | 43,500 | 45,900 | 12 |
| 15 | 76,500 | 6.5 | 5.6 | 74,600 | 78,500 | 27 |
| 16 | 88,400 | 7.1 | 4.3 | 86,100 | 89,700 | 22 |
| Comp. 1 | 55,430 | 16.1 | 4.1 | 54,120 | 57,300 | 11 |
| Comp. 2 | 64,200 | 15.8 | 4.4 | 63,400 | 66,500 | 25 |
| Comp. 3 | 74,200 | 16.2 | 4.8 | 73,100 | 74,900 | 15 |
| Comp. 4 | 46,350 | 18.2 | 4.4 | 44,500 | 47,500 | 17 |
| Comp. 5 | 84,200 | 17.6 | 3.5 | 81,200 | 85,600 | 11 |
| Comp. 6 | 64,300 | 16.7 | 8.8 | 61,200 | 65,800 | 10 |
| Comp. 7 | 78,200 | 16.9 | 4.7 | 74,300 | 79,800 | 7 |
| Comp. 8 | 79,600 | 13.4 | 9.5 | 77,600 | 81,300 | 12 |

TABLE 3

| | Colored Particle No. | Number Average Particle Diameter (in μm) | Ratio of Shape Factor of 1.2 to 1.6 (in %) | Variation Coefficient of Shape Factor (in %) | Ratio of Particles Having No Corners (in %) | Variation Coefficient of Number Distribution | Sum M of m1 and m2 (in %) |
|---|---|---|---|---|---|---|---|
| Example 1 | Colored Particles 1 | 4.2 | 65.8 | 15.8 | 61 | 24.2 | 70.8 |
| Example 2 | Colored Particles 2 | 4.8 | 65.4 | 15.4 | 52 | 24.5 | 65.5 |
| Example 3 | Colored Particles 3 | 5.1 | 65.1 | 15.2 | 48 | 26.4 | 72.7 |
| Example 4 | Colored Particles 4 | 5.2 | 59.1 | 19.4 | 57 | 25.8 | 74.6 |
| Example 5 | Colored Particles 5 | 6.5 | 67.8 | 14.8 | 44 | 30.1 | 64.5 |
| Example 6 | Colored Particles 6 | 5.8 | 60.6 | 16.5 | 55 | 26.7 | 54.2 |
| Example 7 | Colored Particles 7 | 6.2 | 58.1 | 21.4 | 46 | 27.6 | 74.5 |
| Example 8 | Colored Particles 8 | 7.6 | 42.8 | 30.5 | 39 | 32.5 | 38.6 |
| Example 9 | Colored Particles 9 | 5.2 | 67.1 | 14.2 | 59 | 26.2 | 70.2 |
| Example 10 | Colored Particles 10 | 5.7 | 65.7 | 15.4 | 58 | 25.4 | 72.4 |
| Example 11 | Colored Particles 11 | 6.2 | 68.4 | 15.8 | 55 | 25.8 | 73.4 |
| Example 12 | Colored Particles 12 | 4.5 | 67.5 | 15.5 | 62 | 26.5 | 70.2 |
| Example 13 | Colored Particles 13 | 4.1 | 66.4 | 14.4 | 52 | 26.5 | 71.2 |
| Example 14 | Colored Particles 14 | 5.4 | 71.2 | 13.8 | 54 | 25.1 | 74.1 |
| Example 15 | Colored Particles 15 | 5.7 | 72.3 | 14.5 | 62 | 23.7 | 70.6 |
| Example 16 | Colored Particles 16 | 5.6 | 69.5 | 15.4 | 60 | 24.6 | 70.5 |
| Comparative Example 1 | Comparative Colored Particles 1 | 4.6 | 66.5 | 14.8 | 52 | 23.4 | 73.4 |
| Comparative Example 2 | Comparative Colored Particles 2 | 5.7 | 71.2 | 15.7 | 51 | 25.1 | 74 |
| Comparative Example 3 | Comparative Colored Particles 3 | 5.4 | 67.5 | 14.5 | 53 | 24.1 | 70.8 |
| Comparative Example 4 | Comparative Colored Particles 4 | 4.7 | 66.4 | 14.9 | 52 | 26.2 | 72.1 |
| Comparative Example 5 | Comparative Colored Particles 5 | 5.8 | 64.1 | 15.4 | 53 | 26.7 | 73.4 |
| Comparative Example 6 | Comparative Colored Particles 6 | 5.6 | 65.6 | 15.2 | 54 | 26.4 | 71.2 |
| Comparative Example 7 | Comparative Colored Particles 7 | 5.4 | 67.8 | 14.8 | 51 | 23.7 | 72.4 |
| Comparative Example 8 | Comparative Colored Particles 8 | 4.6 | 69.8 | 15.7 | 52 | 25.9 | 71.1 |

Added to each of Colored Particles 1 through 16 and Cooperative Colored Particles 1 through 7 were 0.8 part by weight of hydrophobic silica and 1.0 part by weight of hydrophobic titanium oxide, and the resulting mixture was mixed for 25 minutes while setting the peripheral velocity of the rotation blades of a 10-liter Henschel mixer at 30 m/second. Incidentally, it was confirmed that these colored particles exhibited no variation of shape and particle diameter by the addition of external additives.

Production of Carrier

Production of Ferrite Core Materials

A mixture consisting of 18 mol percent of MnO, 4 mol percent of MgO, and 78 mol percent of $Fe_2O_3$ was crushed for 2 hours, employing a wet ball mill, blended and dried. Thereafter, the resulting mixture was temporarily burned while maintained at 900° C. for 2 hours, and subsequently crushed for 3 hours to form a slurry. Dispersing agents and binders were added, and the resulting mixture was subjected to granulation, employing a spray drier, and subsequently dried. Thereafter, said granulated mixture was subjected to the main burning at 1,200° C. for 3 hours, whereby ferrite core material particles having a resistance of $4.3\times10^8$ Ω·cm were prepared.

Production of Covering Resin

Initially, a cyclohexyl methacrylate/methyl methacrylate (at a copolymerization ratio of 5/5) copolymer was synthesized employing an emulsion polymerization method in which the concentration in an aqueous solution medium employing sodium benzenesulfonate having an alkyl group having 12 carbon atoms as a surface active agent, and fine resinous particles were obtained having a volume average primary particle diameter of 0.1 μm, a weight average molecular weight (Mw) of 200,000, a number average molecular weight (Mn) of 91,000, an Mw/Mn of 2.2, a softening temperature (Tsp) of 230° C., and a glass transition temperature (Tg) of 110° C. Incidentally, said fine resinous particles were treated to be azeotropic with water and the residual monomer amount was adjusted to 510 ppm.

Subsequently, charged into a high-speed mixer employing stirring blades were 100 parts by weight of ferrite core material particles and 2 parts by weight of said fine resinous particles, and the resulting mixture was blended at 120° C. for 30 minutes, and utilizing mechanical impact force action, a resin coated carrier having a volume average particle diameter of 61 μm was prepared.

Production of Developer

Each type of colored particles added with external additives was blended with said carrier, and a developer, having a toner concentration of 6 percent by weight, was prepared.

Production of Photoreceptor P1

The coating compositions described below were applied onto a cylindrical conductive support having a diameter of 60 mm, whereby photoreceptor P1 was prepared.

<Sublayer>

| | |
|---|---|
| Titanium chelate compound (TC-750, manufactured by Matsumoto Seiyaku Co.) | 30 g |
| Silane coupling agent (KMB-503, manufactured by Shin-Etsu Kagaku Co.) | 17 g |
| 2-Propanol | 150 ml |

Said coating composition was applied onto a cylindrical conductive support so as to obtain a layer thickness of 0.5 μm.

<Charge Generating Layer>

| | |
|---|---|
| Y type titanyl phthalocyanine (titanyl phthalocyanine having a maximum peak at 27.2 degrees of Bragg angle 2θ (±0.2 degree) in Cu-Kα characteristic X-ray diffraction spectrometry) | 60 g |
| Silicone modified butyral resin (X-40-1211M, manufactured by Shin-Etsu Kagaku Co.) | 700 g |
| 2 -Butanone | 2000 ml |

were mixed and dispersed for 10 hours employing a sand mill, whereby a charge generating layer coating composition was prepared. The resulting coating composition was applied onto said sublayer employing a dip coating method, whereby a 0.2 μm thick charge generating layer was formed.

<Charge Transport Layer>

| | |
|---|---|
| Charge transport material N-(4-methylphenyl)-N-{4-(β-phenylstyryl)phenyl}-p-toluidine | 225 g |
| Polycarbonate (having a viscosity average molecular weight of 30,000) | 300 g |
| Antioxidant (Exemplified Compound 1–3) | 6 g |
| Dichloromethane | 2000 ml |

were mixed and dissolved to prepare a charge transport layer coating composition. The resulting coating composition was applied onto said charge generating layer employing a dip coating method, whereby a charge transport layer having a dried layer thickness of 20 μm was formed.

<Protective Layer>

| | |
|---|---|
| Methyltrimethoxysilane | 150 g |
| Dimethyldimethoxysilane | 30 g |
| Reactive charge transport compound (Exemplified Compound B-1) | 15 g |
| Polyfluorinated vinylidene particles (having a volume average particle diameter of 0.2 μm) | 10 g |
| Antioxidant (Exemplified Compound 2-1) | 0.75 g |
| 2-Propanol | 75 g |
| 3 Percent acetic acid | 5 g |

were mixed to prepare a resinous layer coating composition. The resulting coating composition was applied onto said charge transport layer, employing a circular amount regulating type coating device so as to form a 2 μm thick resinous layer. The resulting layer was thermally hardened at 120° C. for one hour to form a siloxane resinous layer, whereby Photoreceptor P1 was prepared.

1-3

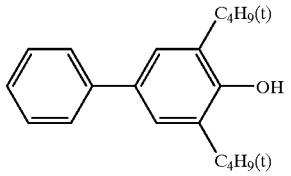

-continued 2-1

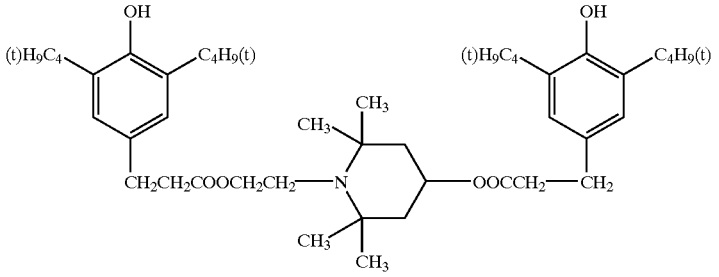

(B-1)

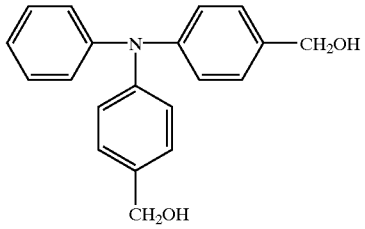

Photoreceptor P1 and each of developers were installed in a digital copier (comprising corona charging, laser exposure, reversal development, electrostatic transfer claw separation, and a cleaning blade) having image forming processes described in FIG. 5, and subsequently evaluated. Evaluation was carried out while setting said digital copier at the following conditions.

Charging Condition

Charging unit: scorotron charging unit. The initial charge potential was set at −750 V.

Exposure Condition

Exposure amount was set to result in an exposed area potential of −50 V.

Development Conditions

DC bias: −550 V

Transfer Electrode: Corona Charging System

Further, the employed fixing unit comprised a heating roller having a surface roughness Ra of 0.8 μm, which was prepared by covering the surface of an iron cylinder with a 25 μm thick PFA (a tetrafluoroethylene-perfluoroalkyl vinyl ether copolymer) and a pressing roller having a surface roughness Ra of 0.8 μm, which was prepared by covering an iron cylinder with HTV silicone rubber which was further covered with a 120 μm thick PFA tube. Incidentally, its nip width was 3.8 mm and a linear rate was 420 mm/second.

Further, said cleaning unit was provided with neither a cleaning mechanism nor a silicone oil supplying mechanism. Fixing temperature was controlled employing said heating roller and set at 165° C.

As copying conditions, 500,000 copies were continuously prepared at low temperature and low humidity (10° C. and 20 percent relative humidity). The off-setting resistance of copied images, the staining during bookbinding, the standard glossiness, the cleaning properties, the filming generation of the photoreceptor were evaluated based on the criteria described below.

An original image consisting of equal quarters of a text image having a pixel ratio of 7 percent, a portrait picture image, a solid white image, and a solid black image was copied onto A4 acid-free paper sheets. At every 10,000th copy, halftone images, solid white images, solid black images and fine line images were evaluated.

Off-Setting Resistance

After continuously copying said original onto 1,000 A4 transfer sheets, a white sheet was copied. Subsequently, stain on the white sheet and the toner adhesion on the surface of the heating roller were visually evaluated. Incidentally, employed as transfer sheets for evaluation were fine-quality 200 g/m$^2$ weight paper sheets, and 0.3 mm wide and 150 m long line images parallel to the sheet advancing direction (the heating roller circumferential direction) were formed.

A: image off-setting on the white paper sheet was not noticed and the toner adhesion on the heating roller was not noticed B: image off-setting on the white paper sheet was noticed but the toner adhesion on the heating roller was noticed C: image off-setting on the white paper sheet was noticed.

In the above evaluation, A and B are commercially available, but C is not commercially available. Staining during Bookbinding Both sides of 64 g/m$^2$ plain paper sheet were copied and 100 copied sheets were subjected to bookbinding. Thereafter, each of all pages was manually turned 20 times and stain on the white background was observed.

Rank A: stain was not formed on the image

Rank B: very slight stain was formed on the image (at the level which does not result in any problem with commercial viability)

Rank C: slight stain was formed on the image (at the level which results in no problem with commercial viability)

Rank D: stain was formed on the image and resulted in no commercial viability.

Evaluation ranks A, B, and C were judged to be commercially viable and D was judged to be not commercially viable.

Standard Glossiness

The standard glossiness of an image part, in which the recording material is covered with at least 90 percent of image forming materials (electrostatic image developing toner and the like), was measured at an incident angle of 75 degrees, employing Gross Meter VGS-LD (manufactured by Nihon Denshoku Kogyo Co., Ltd.).

When said standard glossiness is from 17 to 37, photographic images result in three-dimensional feel due to appropriate gloss and characters are easily readable.

A: standard glossiness of 22 to 32

B: standard glossiness of 17 to 22 or 32 to 37

C: standard glossiness of less than 17 or n less than 37

Evaluation ranks A and B were judged to be commercially viable and C was judged to be not commercially viable.

Photoreceptor Filming

By observing the surface of the photoreceptor after continuous production of 500,000 copies, the presence or absence of the filming was noticed.

Uniformity of Halftone

After continuous production of 500,000 copies, the photoreceptor filming as well as the uniformity of halftone images due to variation of transferability was evaluated based on the rank described below.

Rank A: uniform image without mottles

Rank B: presence of very slight streak-shaped mottles

Rank C: presence of several slight streak-shaped mottles, which are commercial viable Rank D: presence of more than several clear streak-shaped mottles Evaluation ranks A, B, and C were judged to be commercially viable and D was judged to be not commercially viable.

Minute Spots around Dot

A halftone dot image, which occupied 10 percent of the whole image, was prepared. Subsequently, tiny spots around dots were observed employing a hand magnifier, and evaluated based on the criteria described below.

A: tiny spots were barely noticed

B: there were slightly tiny spots, but if they were not carefully observed, they would not be noticed C: tiny spots were easily noticed Table 4 shows the results.

TABLE 4

| | Off-Setting | Staining during Bookbinding | Standard Glossiness | Toner Filming of Photoreceptor | Halftone Uniformity | Tiny Spots |
|---|---|---|---|---|---|---|
| Example 1 | A | A | A | none up to the 500,000th sheet | A | A |
| Example 2 | A | A | A | none up to the 500,000th sheet | B | A |
| Example 3 | A | B | A | none up to the 500,000th sheet | B | A |
| Example 4 | A | B | A | none up to the 500,000th sheet | B | A |
| Example 5 | A | C | A | none up to the 500,000th sheet | B | B |
| Example 6 | A | C | B | none up to the 500,000th sheet | B | B |
| Example 7 | A | C | B | none up to the 500,000th sheet | B | B |
| Example 8 | A | C | B | none up to the 500,000th sheet | C | B |
| Example 9 | A | A | A | none up to the 500,000th sheet | A | B |
| Example 10 | A | A | A | none up to the 500,000th sheet | A | B |
| Example 11 | A | A | A | none up to the 500,000th sheet | B | B |
| Example 12 | A | A | A | none up to the 500,000th sheet | B | B |
| Example 13 | B | C | B | none up to the 500,000th sheet | B | B |
| Example 14 | B | C | B | none up to the 500,000th sheet | B | B |
| Example 15 | B | C | B | none up to the 500,000th sheet | B | B |
| Example 16 | B | C | B | none up to the 500,000th sheet | B | B |
| Comparative Example 1 | C | D | C | occurred at the 30,000th sheet | D | B |
| Comparative Example 2 | C | D | C | occurred at the 50,000th sheet | D | C |
| Comparative Example 3 | C | D | C | occurred at the 50,000th sheet | D | C |
| Comparative Example 4 | C | D | C | occurred at the 50,000th sheet | D | C |
| Comparative Example 5 | C | D | C | occurred at the 50,000th sheet | D | C |
| Comparative Example 6 | C | D | C | occurred at the 50,000th sheet | D | C |
| Comparative Example 7 | C | D | C | occurred at the 50,000th sheet | D | C |
| Comparative Example 8 | C | D | C | occurred at the 50,000th sheet | D | C |

As can clearly be seen from the aforesaid examples, by employing Examples 1 through 16 according to the present invention, it was confirmed that images, which exhibited desired off-setting resistance as well as suitable gloss, were obtained. Further, it was confirmed that since crystalline materials, which exhibited a releasing performance, were bled onto the surface of fixed images, the toner of the present invention exhibited resistance against rubbing and did not stain other transfer sheets of paper when copied sheets were stored upon being stacked. Still further, it was confirmed that the toner of the present invention resulted in excellent image characteristics in such a manner that since an amount of crystalline materials released from said toner decreased, photoreceptor filming did not occur, and since the fluidity was also improved, excellent cleaning properties were obtained.

As can clearly be seen from the aforesaid examples, in the toner of the present invention, namely in the toner particle comprised of a domain-matrix structure, it becomes possible to uniformly control domain portions, comprised of crystalline materials, occupying state. As a result, off-setting resistance is markedly enhanced. Further, it becomes possible to minimize release of crystalline materials as well as colorants from a toner particle, whereby photoreceptor filming is minimized.

Further, though it is proposed that conventional toner particles are comprised of a domain-matrix structure, a definite ratio of toner particles exists which have no domain-matrix structure. However, in the present invention, it has become possible to assuredly incorporate crystalline materials as the additive into a toner particle, whereby it has made it possible to achieve oil-free fixing.

Still further, by utilizing the fact that the protective layer comprised of releasing agents, having a low friction coefficient, is formed on the surface of fixed images, stain during bookbinding has been minimized, and obtained images have exhibited suitable gloss and have resulted in faithful reproduction of digital images which exhibit excellent fine line reproduction.

What is claimed is:

1. An electrostatic image developing toner, which comprises a resin, a colorant, and a crystalline material, wherein a particle of said toner has a domain-matrix structure, wherein said resin forms a portion corresponding to non-domain portion around said domain, and said domains include domains comprised of said crystalline material and domains comprised of said colorant; and the average of the horizontal FERE diameter of the part corresponding to said domain is from 200 to 900 nm; and the variation coefficient of said horizontal FERE diameter is 40 percent or less.

2. The electrostatic image developing toner of claim 1, wherein the domains have different luminance.

3. The electrostatic image developing toner of claim 1 wherein the ratio of toner particles without corners is at least 50 percent by number and the number variation coefficient in the number particle size distribution is 27 percent or less.

4. The electrostatic image developing toner of claim 1 wherein the ratio of toner particles, having a shape factor in the range of 1.2 to 1.6, is at least 65 percent by number, and the number variation coefficient in the number particle size distribution is 27 percent or less and the toner having a variation coefficient of the toner shane coefficient of not moe than 16 percent.

5. The electrostatic image developing toner of claim 1 wherein sum M of relative frequency m1 and m2 of toner particles is at least 70 percent, which is included in the most frequent class in the histogram which shows the particle size distribution based on the number of particles which is drawn in such a manner that regarding said toner, when the particle diameter of toner particles is represented by D in $\mu$m, natural logarithm ln D is taken as the abscissa, and said abscissa is divided into a plurality of classes at an interval of 0.23.

6. The electrostatic image developing toner of claim 1, wherein said toner has a number average particle diameter of 3 to 9 $\mu$m.

7. The electrostatic image developing toner of claim 1, wherein said toner is prepared by polymerizing at least a polymerizable monomer in a water-based medium.

8. The electrostatic image developing toner of claim 1, wherein said toner is prepared by aggregating and fusing at least resinous particles in a water-based medium.

9. The electrostatic image developing toner of claim 1, wherein said toner is prepared by salting out/fusing colorant particles and fine composite resinous particles which have been formed through a process to polymerize a polymerizable monomer after dissolving a crystalline material in at least said polymerizable monomer.

10. The electrostatic image developing toner of claim, 1, wherein said toner is prepared by salting out/fusing colorant particles and fine composite resinous particles prepared by a multi-step polymerization method.

11. The electrostatic image developing toner of claim 1, wherein said toner is prepared by forming a resinous layer which is prepared by fusing resinous particles employing a salting out/fusion method on resinous and colored particles.

12. An electrostatic image developing toner, which comprises a resin, a colorant, and a crystalline material, wherein a particle of the toner has a domain-matrix structure, wherein said resin forms a portion corresponding to non-domain portion around said domain, and said domains include domains comprised of said crystalline material and domains comprised of said colorant; and a ratio of toner particles having from 1 to 20 domains per said toner particle is at least 99 percent by number of the toner as a whole.

13. An electrostatic image developing toner, which comprises a resin, a colorant, and a crystalline material, wherein a particle of said toner has a domain-matrix structure, wherein said resin forms a portion corresponding to non-domain portion around said domain, and said domains include domains comprised of said crystalline material and domains comprised of said colorant;

the average of the shape factor of said domain is from 140 to 220; its variation coefficient is 35 percent or less;

the ratio of domains having said shape factor in the range of 100 to 120 is 10 percent or less; and the ratio of domains having said shape factor of at least 240 is 15 percent or less.

14. An electrostatic image developing toner, which comprises a resin, a colorant, and a crystalline material, wherein a particle of said toner has a domain-matrix structure, wherein said resin forms a portion corresponding to non-domain portion around said domain, and said domains, include domains comprised of said crystalline material and domains comprised of said colorant;

the average of the shape factor of said domain is from 160 to 200; its variation coefficient is 35 percent or less;

the ratio of domains having said shape factor in the range of 100 to 120 is 5 percent or less; and the ratio of domains having said shape factor of at least 240 is 10 percent or less.

15. An electrostatic image developing toner, which comprises a resin, a colorant, and a crystalline material, wherein a particle of said toner has a domain-matrix structure; the average of the area of a Voronoi polygon formed by the perpendicular bisecting line between the centers of gravity of domains adjacent to each other in said domain-matrix structure is from 20,000 to 120,000 $nm^2$; and the variation coefficient of the area of said Voronoi polygon is 25 percent or less.

16. An electrostatic image developing toner, which comprises a resin, a colorant, and a crystalline material, wherein a particle of said toner has a domain-matrix structure; the average of the area of a Voronoi polygon formed by the perpendicular bisecting line between the centers of gravity of domains adjacent to each other in said domain-matrix structure is from 40,000 to 100,000 $nm^2$; and the variation coefficient of the area of said Voronoi polygon is 20 percent or less.

17. An electrostatic image developing toner, which comprises a resin, a colorant, and a crystalline material, wherein a particle of said toner has a domain-matrix structure; the average of the area of a Voronoi polygon formed by the perpendicular bisecting line between the centers of gravity of the domains in the interior of a 1,000 nm radius circle having the center of gravity in the cross-section of said toner particle as the center is sinalier than the average of the area of a Voronoi polygon formed by the perpendicular bisecting line between the centers of gravity of said domain in the exterior of said circle.

18. An electrostatic image developing toner, which comprises a resin, a colorant, and a crystalline material, wherein a particle of said toner is comprised of a domain-matrix structure, and of Voronoi polygons formed by the perpendicular bisecting line between the centers of gravity of domains adjacent to each other in said domain-matrix structure, there are 5 to 30 domains having an area of the Voronoi polygon of at least 160,000 $nm^2$ which comes into contact with the external circumference of said toner.

* * * * *